US008485950B2

(12) United States Patent
Adams

(10) Patent No.: US 8,485,950 B2
(45) Date of Patent: Jul. 16, 2013

(54) MULTI-POSITION RESISTANCE TUBE EXERCISE APPARATUS

(76) Inventor: Frederick R. Adams, Healdsburg, CA (US)

( * ) Notice: Subject to any disclaimer, the term of this patent is extended or adjusted under 35 U.S.C. 154(b) by 0 days.

(21) Appl. No.: 13/565,722

(22) Filed: Aug. 2, 2012

(65) Prior Publication Data

US 2013/0035220 A1 Feb. 7, 2013

Related U.S. Application Data

(60) Provisional application No. 61/514,310, filed on Aug. 2, 2011.

(51) Int. Cl.
*A63B 21/04* (2006.01)
*A63B 21/055* (2006.01)

(52) U.S. Cl.
USPC ..... 482/129; 482/92; 482/904; 482/908

(58) Field of Classification Search
USPC ..... 482/92, 103, 121, 129, 904, 102, 482/122, 123, 126, 130, 908, 910
See application file for complete search history.

(56) References Cited

U.S. PATENT DOCUMENTS

| | | | | |
|---|---|---|---|---|
| 254,108 | A * | 2/1882 | Bryon, Jr. | 482/129 |
| 4,402,504 | A * | 9/1983 | Christian | 482/103 |
| 4,666,151 | A * | 5/1987 | Chillier | 482/135 |
| 4,685,670 | A * | 8/1987 | Zinkin | 482/129 |
| 4,747,594 | A * | 5/1988 | Houde | 482/72 |
| 4,830,365 | A * | 5/1989 | March | 482/129 |
| 5,050,869 | A * | 9/1991 | Frate | 482/94 |
| 5,385,525 | A * | 1/1995 | Davis | 482/121 |
| 5,468,205 | A * | 11/1995 | McFall et al. | 482/129 |
| 5,484,368 | A * | 1/1996 | Chang | 482/122 |
| 5,586,962 | A * | 12/1996 | Hallmark | 482/129 |
| 6,015,371 | A * | 1/2000 | Davitt | 482/129 |
| 6,165,110 | A * | 12/2000 | Gajda | 482/102 |
| 6,267,711 | B1 * | 7/2001 | Hinds | 482/121 |
| 6,319,179 | B1 * | 11/2001 | Hinds | 482/121 |
| 6,689,025 | B2 * | 2/2004 | Emick | 482/123 |
| 7,651,450 | B2 * | 1/2010 | Wehrell | 482/124 |
| 7,815,552 | B2 * | 10/2010 | Dibble et al. | 482/92 |
| 7,976,445 | B2 * | 7/2011 | Lalaoua | 482/129 |
| 7,988,601 | B2 * | 8/2011 | Bowser | 482/57 |
| 8,057,368 | B1 * | 11/2011 | Lyszczarz | 482/103 |
| 2010/0173759 | A1 | 7/2010 | Lalaoua | |
| 2012/0065035 | A1 * | 3/2012 | Makula | 482/129 |

FOREIGN PATENT DOCUMENTS

WO WO 8704633 A1 * 8/1987

OTHER PUBLICATIONS http://www.officialtower200.com/Indexnochat=1&clickid=VyQR8t1k7zTuSpbQpcxaq0vqUkUTUGSThQeH2g0&irpid=13929&isir=1&irext=Google.brand&irsrc=search [online] [retrieved on Aug. 15, 2012].

http://www.weiderfitness.com/webapp/wcs/stores/servlet/Product__-1__14801__17102__48003__131103 [online] [retrieved on Aug. 15, 2012].

* cited by examiner

*Primary Examiner* — Loan Thanh
*Assistant Examiner* — Victor K Hwang
(74) *Attorney, Agent, or Firm* — Craig M. Stainbrook; Stainbrook & Stainbrook, LLP

(57) ABSTRACT

A wall-mounted multi-position pulley-based resistance tube exercise apparatus having resistance tube length effectively doubled for increased range of consistent resistance, and having a height adjustable pulley assembly providing a user with the ability to set multiple exercise initiation points so as to provide exercise options for a full body workout at a single exercise station.

23 Claims, 23 Drawing Sheets

MULTI-POSITION RESISTANCE TUBE EXERCISE APPARATUS

CROSS REFERENCES TO RELATED APPLICATIONS

The present application claims the benefit of the filing date of U.S. Provisional Patent Application Ser. No. 61/514,310, filed Aug. 2, 2011 (Aug. 2, 2011).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

SEQUENCE LISTING

Not applicable.

BACKGROUND OF THE INVENTION

1. Field of the Invention

The present invention relates generally to exercise machines, and more particularly to multi-position weight machines, and still more particularly to a multi-position wall-mounted resistance tube exercise apparatus that enables a user to achieve a full body workout, including a core workout, principally from a standing position exclusively, though numerous seated exercises are also possible. The apparatus is well-suited for transport and particularly well adapted for use by truck drivers for maintaining good body conditioning during long hauls.

2. Background Discussion

Multi-position resistance tube exercise machines are known. A number of major exercise machine manufacturers make and sell commercial and residential machines either dedicated to particular exercises or a small group of exercises designed to exercise small groups of muscles or, alternatively, machines designed to enable a user to perform a number of exercises and to address a wide range of muscles and muscle groups. Traditionally, the systems have employed moveable weight stacks incorporated into compact frame structures with attachments to the stack from multiple directions and at multiple positions and angles through cable and pulley assemblies so as to provide a user with numerous exercise options.

However, weight stack systems have several liabilities. First, comprehensive systems are very expensive. Second, they require the allocation of significant floor space. Third, they provide an imperfect, and some say inherently flawed, simulation of the kinds of load placed on muscles in natural and competitive athletic environments. Fourth, the load borne by the user tends to vary dramatically through a full range of motion during any given exercise. Fifth, they can present a risk of injury. And finally, by their very nature they are, for all practical purposes, permanent fixtures. Increasingly physiatrists, physical therapists, gyms, schools, and especially individuals wishing to experience a full body workout, are relying on resistance tubes and bands as the means to place a load on specific muscles and muscle groups for resistance exercise. For the most part, such "systems" amount to little more than one or more resistance tubes adapted for connection to walls, doors, furniture, and the like, to provide a simple way of achieving multiple angles from which resistance is offered. However, such systems rely on reliable and safe connections in the environment and they are limited by the size and therefore the resilience of the (typically) single tube employed.

Two products currently on the market—the Tower 200 from Body by Jake and the X-Factor from Weider—are door mounted units, use a length of resistance tubing with pulleys and attachment hooks on each end, top and bottom. This limits the stretch to the degree to which the single resistance tube will stretch. There is no adjustment for initiation points other than top and bottom.

BRIEF SUMMARY OF THE INVENTION

It is therefore a principal and primary object of the present invention to provide a new and improved wall-mounted multi-position resistance tube weight apparatus that enables a user to perform a complete workout.

It is another object of the present invention to provide a new and improved wall-mounted multi-position resistance tube weight apparatus in which most exercises can be performed with the feet placed on the ground, thereby minimizing the risk of injury and requiring that core stabilizing and balancing muscles be recruited to perform exercises properly and smoothly.

An even further object of the present invention is to provide a wall-mounted resistance tube based weight training apparatus for resistance training that enables users to easily and rapidly configure exercise stations for complex sport-specific exercises.

A still further object of the present invention is to provide a transportable wall-mounted resistance tube exercise apparatus particularly well-suited for use by long haul truckers who may mount the apparatus on the side of their truck or trailer for use when on the road.

The present invention addresses the shortcomings multi-position weight stack machines as well as multi-position resistance tubing machines currently in the market. With the present invention each end of a rubber rope is attached to a moveable pulley carriage that can be moved up and down. The rubber rope is effectively doubled using a loop or rope return system so that the rope will stretch to the doubled length. Rubber rope generally does not stretch as much as resistance tubing. Thus, by doubling the length of the rubber rope around the upper and lower pulley, the stretch is, in effect, doubled over a rope having a length spanning only the distance between pulleys. This method also combines the range of motion of the resistance tube with the toughness of rubber rope.

Many multi-position machines that use a weight stack also have a provision to adjust the initiation point up and down. Multi-position weight stack machines use a cable to lift the stack for resistance. The cable stays the same length as it moves the weight stack vertically, and as most multi-position machines have a movable pulley on top of the weight stack, the resistance is reduced by one-half. With the present invention the rope provides resistance which increases as it lengthens with no moveable pulley during exercise to reduce resistance.

In a preferred embodiment, the present invention uses wall mounted brackets so that the unit can be easily moved from one location to another that has the same wall brackets; for instance truck cargo trailers. Additionally, it can be configured in a side-by-side relationship with a second system so that more resistance can be provided or so that vastly different exercises calling for very different initiation points (e.g., lat pulldowns and upright rows) can be set up for rapid changes, such as when doing using advanced set structures, including super sets, pyramids, breakdowns, forced reps, and weight stripping.

In an alternative embodiment, the present invention is configured for use near a vehicle, preferably by mounting the apparatus on a plate which can be pinned to the ground and stabilized by driving a heavy vehicle tire onto the plate such that a tire is on the plate, and then parking the vehicle in place.

Other novel features which are characteristic of the invention, as to organization and method of operation, together with further objects and advantages thereof will be better understood from the following description considered in connection with the accompanying drawings, in which preferred embodiments of the invention are illustrated by way of example.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
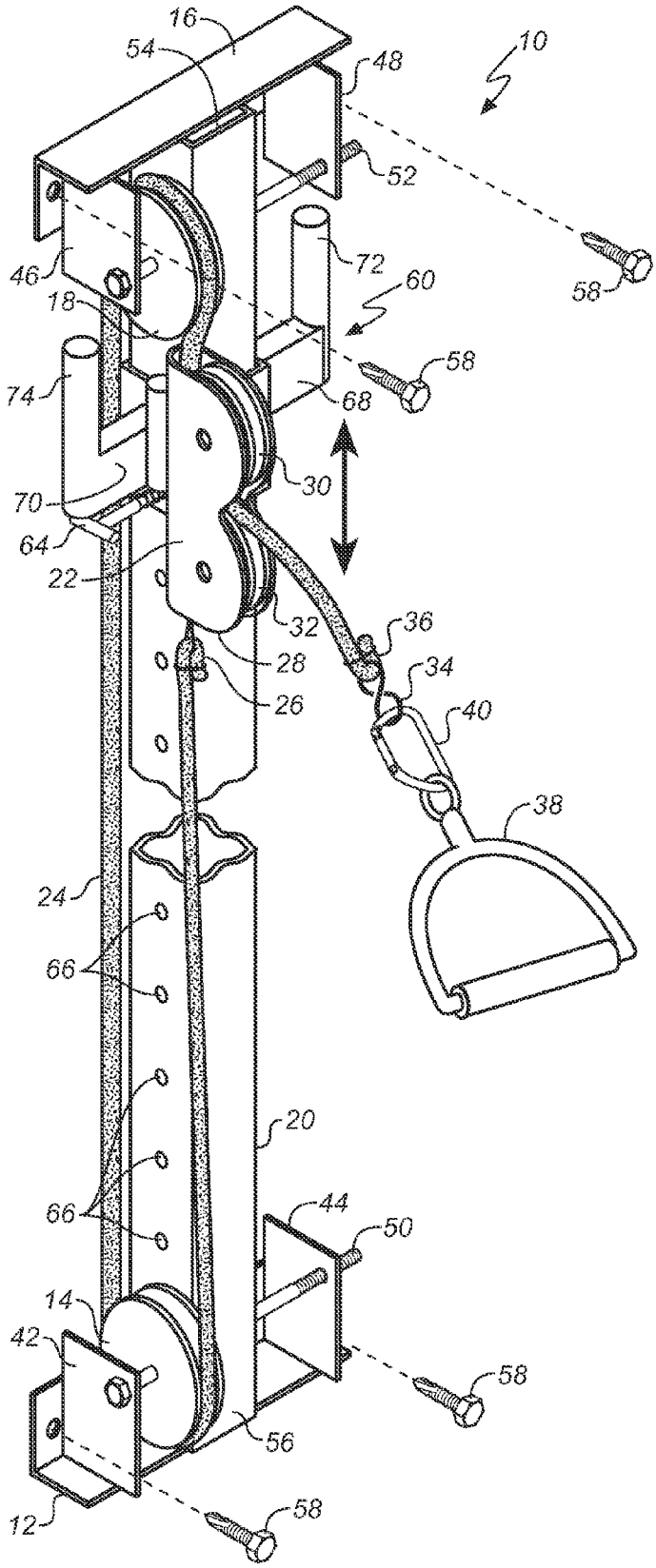
FIG. 1 is an upper front left perspective view of a first preferred embodiment of the inventive wall-mounted multi-position resistance tube exercise apparatus, in this instance a permanently mounted machine.
Figure 2A:
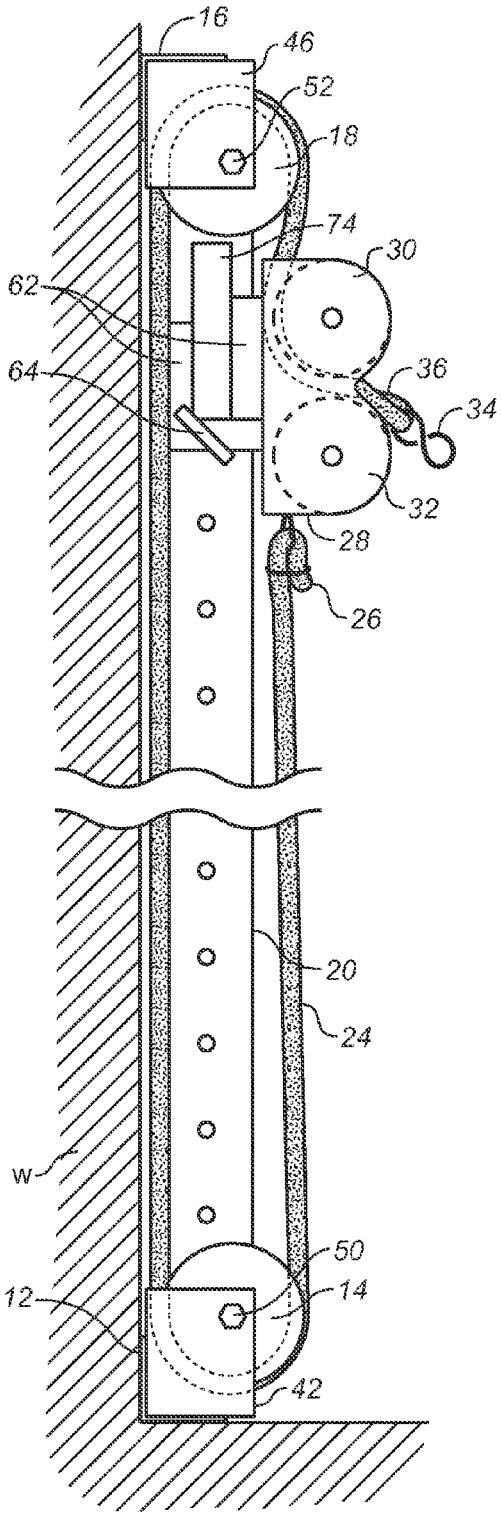
FIG. 2A is a schematic cross-sectional side view in elevation of the apparatus of FIG. 1 showing the movable pulley assembly in an uppermost position.
Figure 2B:
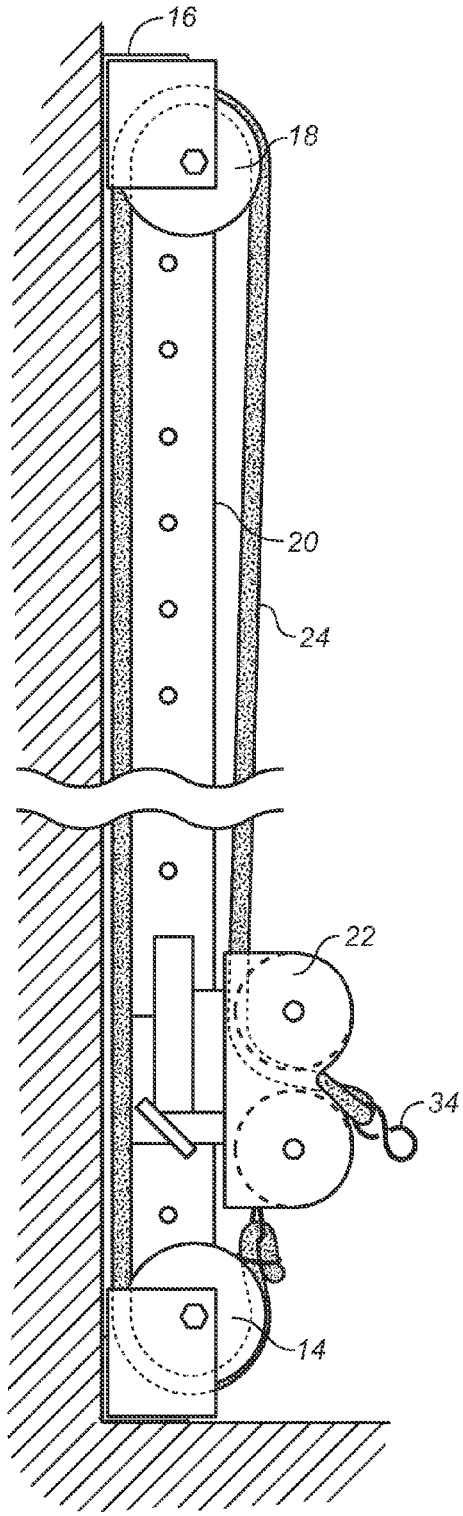
FIG. 2B a schematic cross-sectional side view in elevation of the apparatus of FIG. 1 showing the movable pulley assembly in an lowerrmost position.
Figure 3A:
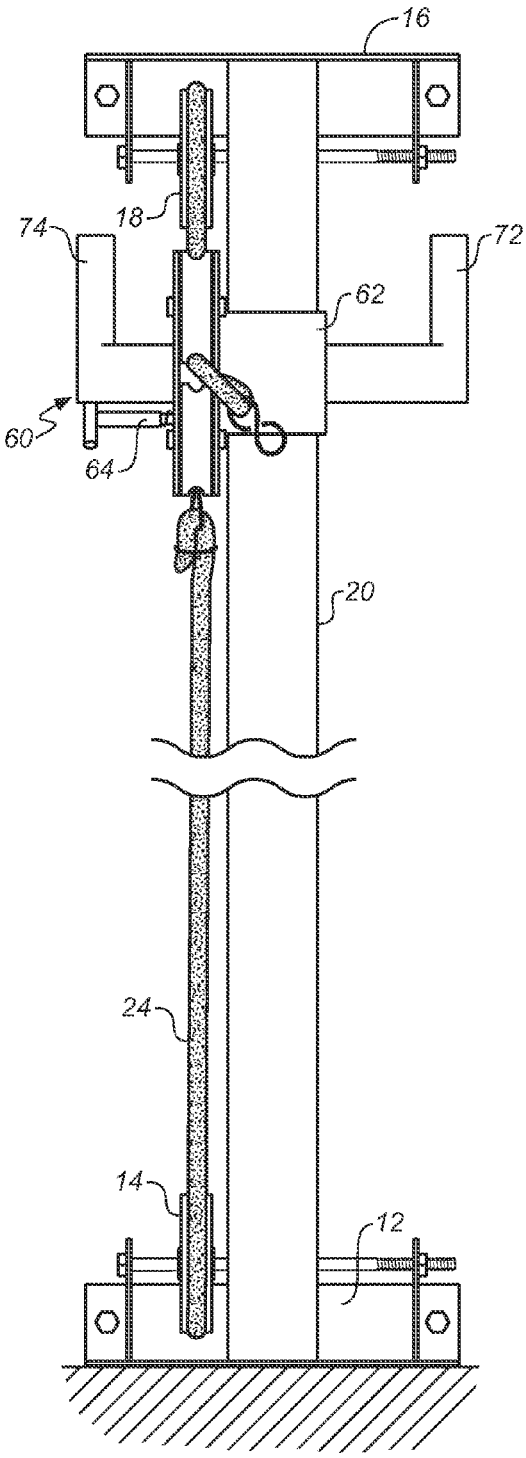
FIG. 3A is front view in elevation of the apparatus shown to FIG. 2A.
Figure 3B:
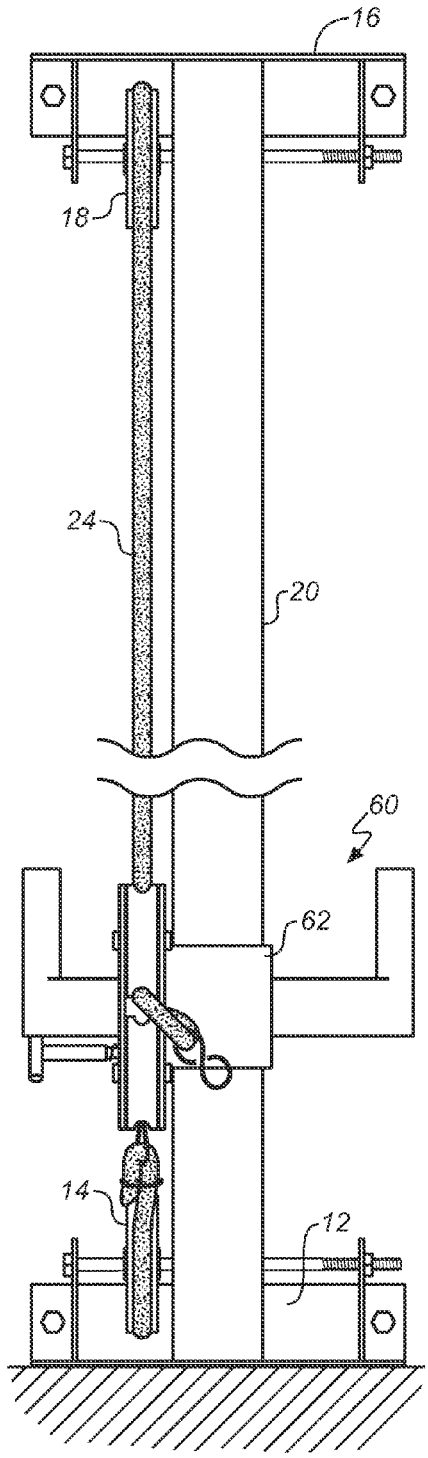
FIG. 3B is a front view in elevation of the apparatus shown in FIG. 2B.
Figure 4A:
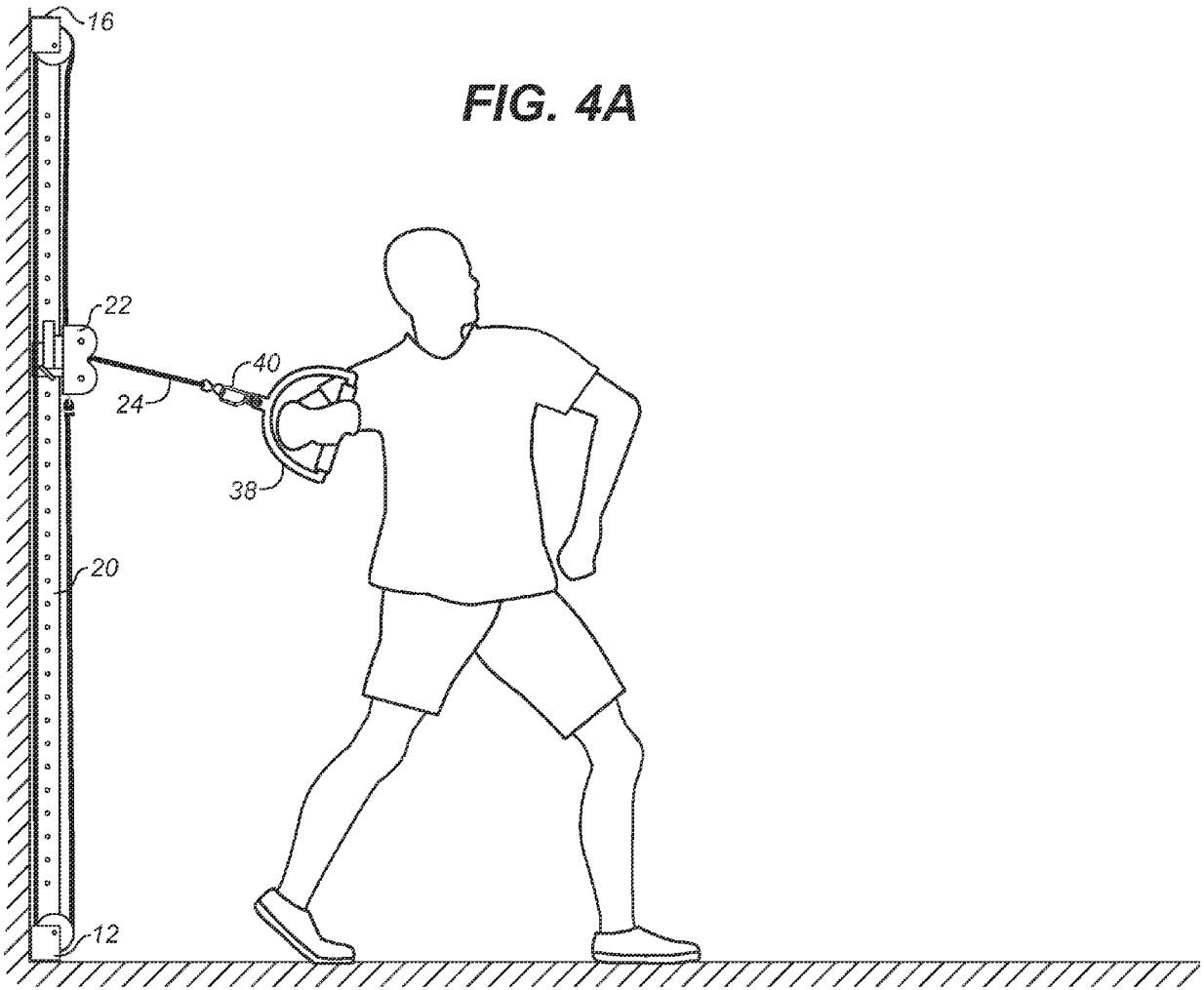
FIG. 4A is a side view in elevation showing a user poised to execute a right arm punch with the movable pulley assembly in a partially elevated position approximately at the shoulder height of the user.
Figure 4B:
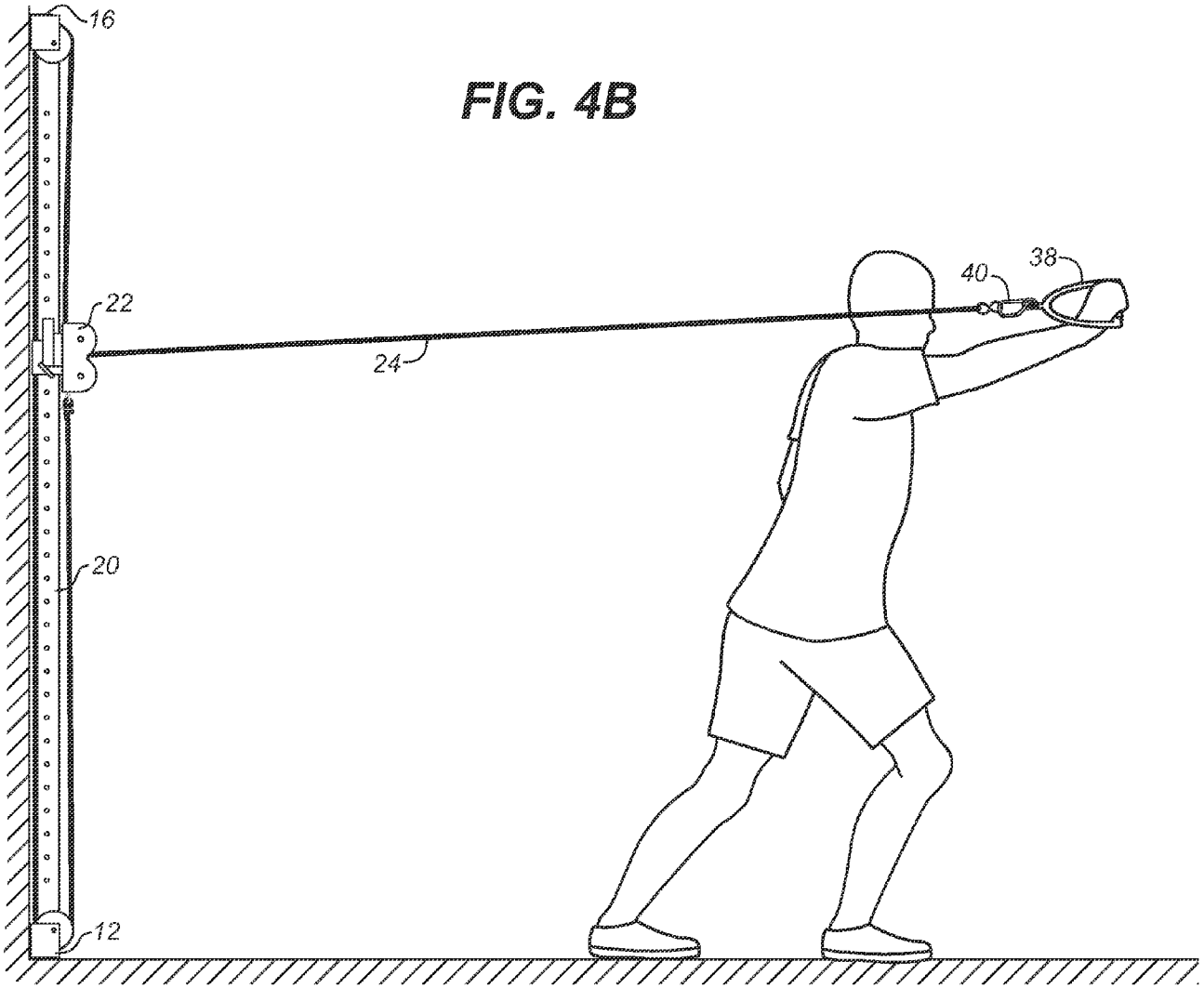
FIG. 4B shows the user of FIG. 4A having executed a repetition of the exercise.
Figure 5A:
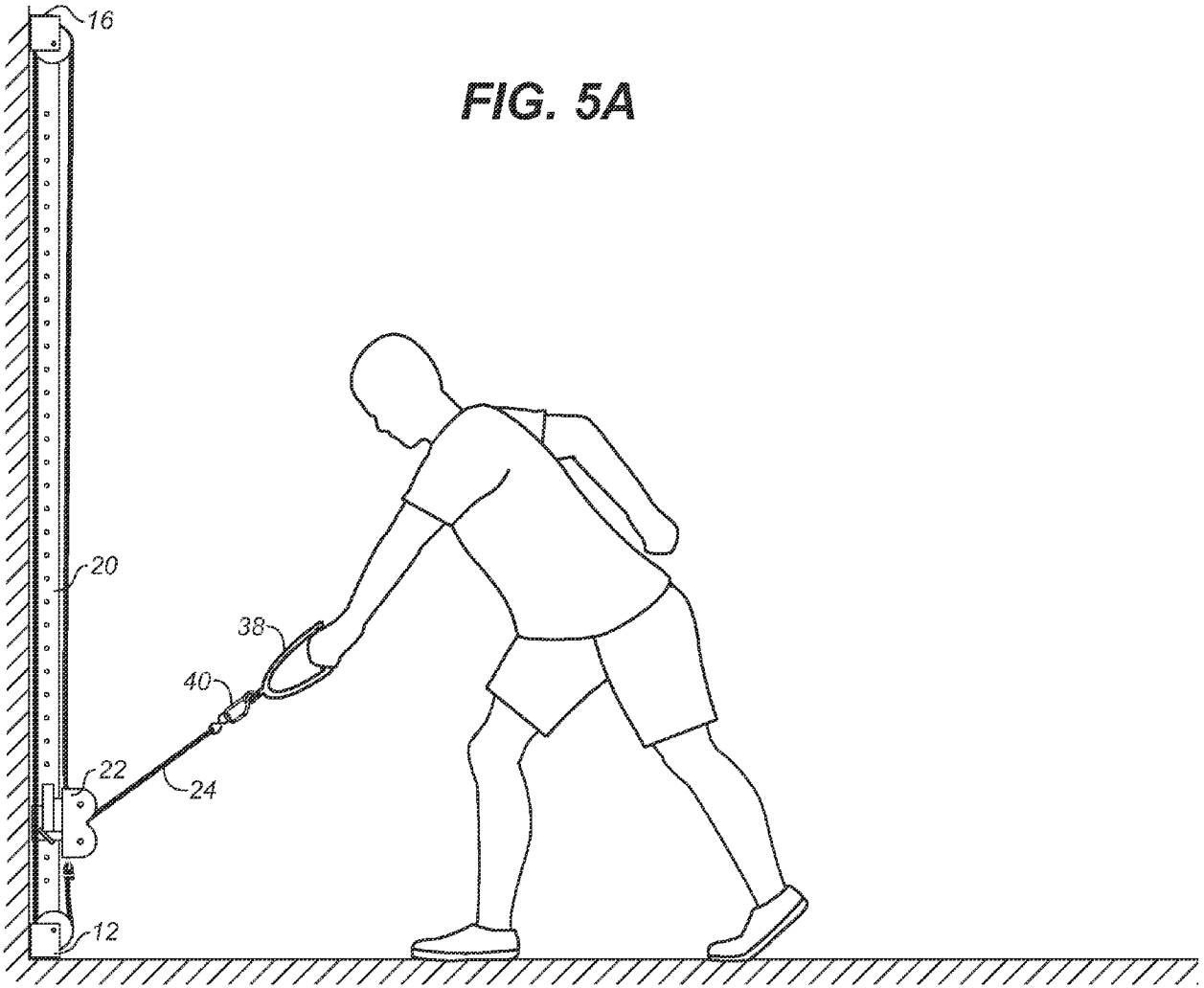
FIG. 5A is a side view in elevation of a user poised to execute a complex exercise involving left arm elevation and abduction with a trunk twist.
Figure 5B:
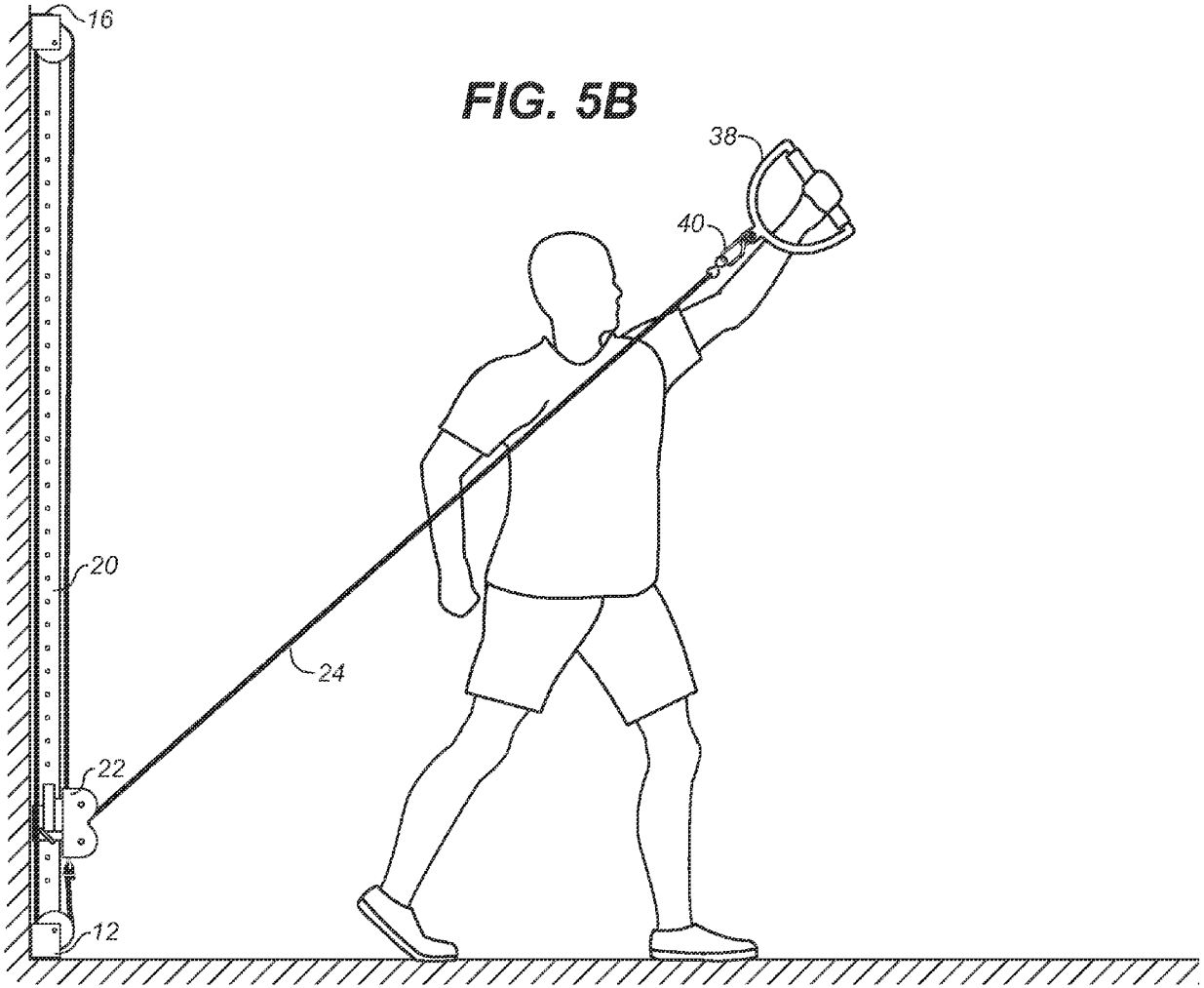
FIG. 5B shows the user of FIG. 5A having executed a repetition of the exercise.
Figure 6:
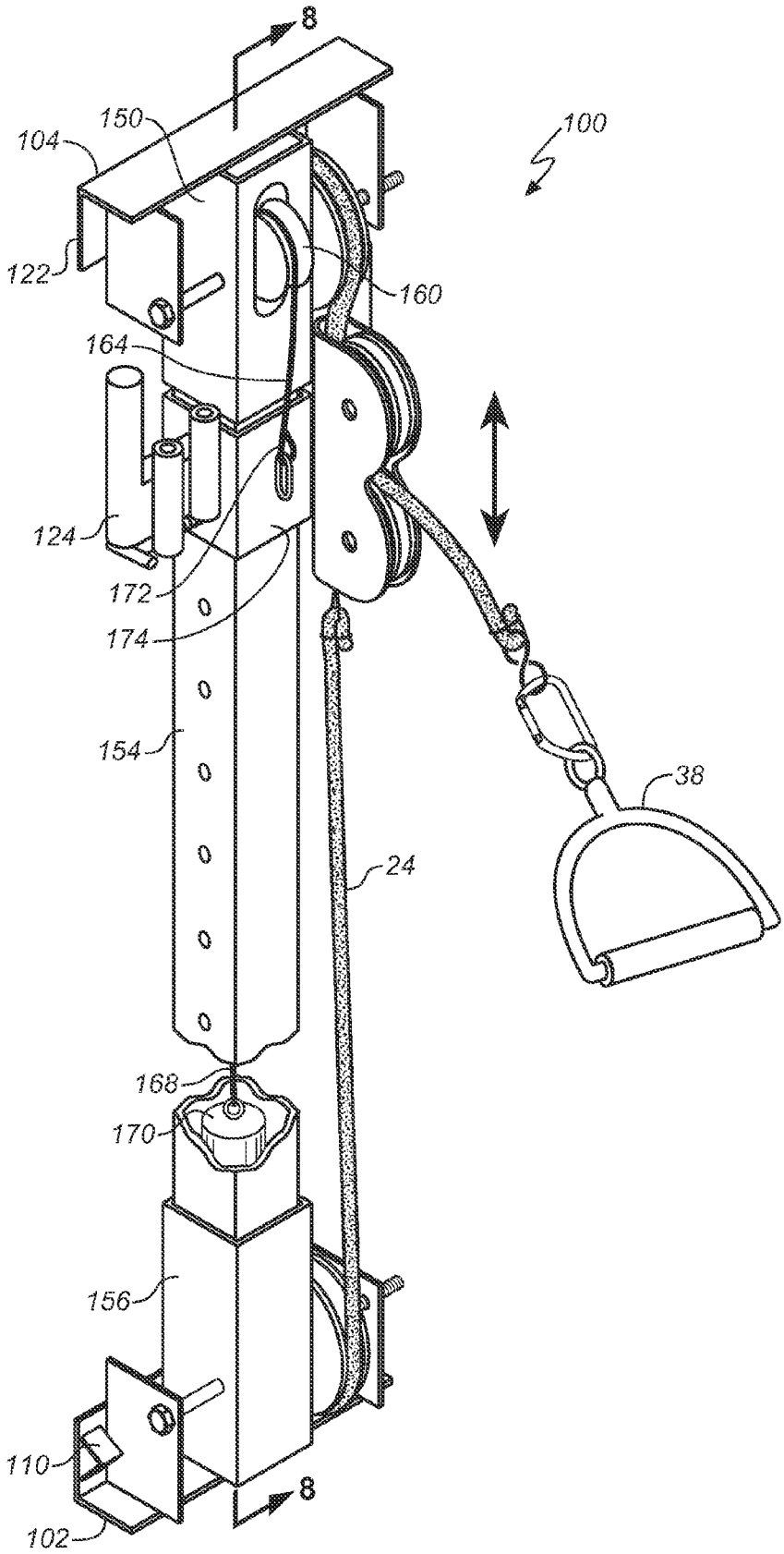
FIG. 6 is an upper left front perspective view showing a second preferred embodiment of the inventive wall-mounted multi-position resistance tube exercise apparatus of the present invention showing the movable pulley assembly in the uppermost position and showing the counterweight employed in the movable pulley adjustment mechanism.

Referring first to FIGS. 1 through 5B, wherein like reference numerals refer to like components in the various views, there is illustrated therein a first preferred embodiment of a new and improved wall-mounted multi-position resistance tube exercise apparatus, generally denominated 10 herein. It should be noted from the outset that while the term "resistance tube" is used herein and recited as the resistance element employed in the inventive apparatus, in a preferred embodiment solid core rubber rope is used instead. Latex rubber resistance bands and tubing of the kind typically used for exercise and physical therapy apparatus tend to dry, crack, and fail after even short periods of heavy use. Accordingly, solid core EPDM rubber rope, which is considerably more durable, is the preferred article for providing resistance in the machine. Kinedyne Corporation of Branchburg, N.J., for instance, provides several suitable products under the generic product name of "rubber rope." Different rope diameters can be employed to provide different levels of resistance. Heavy duty bungee cords may also be used. It will he appreciated, therefore, that the inventive concept is not limited by the selection of tube materials, and thus the term "resistance tube" is used to range over the possible selections, all of which denote elastic cords of some kind, and all of which are suitable for use with a pulley or sheave having a groove between two flanges.

In a first preferred embodiment, the present invention 10 is adapted for substantially permanent installment on a wall W, and includes a lower mounting bracket 12 on which is disposed a lower fixed pulley 14, an upper mounting bracket 16 on which is disposed an upper fixed pulley 18, a vertical post 20 disposed between the upper and lower mounting brackets, and a movable pulley assembly 22 (preferably, but not limited to, a double pulley) slidably and adjustably mounted on the vertical post. A resistance tube 24 is affixed at its first end 26 to the bottom 28 of the movable pulley assembly and threaded around and under the lower fixed pulley wheel 14, then up and over the upper fixed pulley wheel 18, and then down again and behind the upper wheel 30 of the movable pulley assembly 22 and through and between the upper and lower pulley wheels 30, 32, respectively, of the movable pulley assembly. A hook 34 is attached to the second end 36 of the resistance tube, to which may be attached any of a number of suitable handles 38, preferably using rapid connect/disconnect means, such as a carabiner 40 or other kind of coupling clip. The direction of threading the resistance tube may be reversed with no appreciable effect on apparatus function. While the movable pulley assembly includes first and second pulley wheels disposed in a stacked configuration, the assembly does not function as a block and tackle, as both pulleys remain fixed on the pulley carriage 60, and no load is actually moved—rather, resistance tube is stretched. Therefore system is configured only to facilitate a smooth transfer of the stretch throughout the tube from the user's handle, through the inevitable change of direction of stretch or pull occasioned by one or the other of the moving pulleys 30, 32, and ultimately to the first end 26 of the tube, where it is affixed to the movable pulley assembly 22. Regardless of which direction the second end of the resistance tube is threaded through the pulley assembly, the length of the resistance tube is slightly longer than the height of the vertical post. This is not merely the operational predicate for providing a pulley-based resistance tube exercise apparatus with multiple possible exercise initiation points; rather, it is also a means of providing a longer range of generally balanced resistance. Thus, a salient feature of the inventive apparatus resides in the "doubled" length of the resistance tube cooperating with the pulley assembly to provide an extended pull with even and consistent resistance as the second end of the resistance tube is pulled, or translated, away from the movable pulley assembly, either upwardly, downwardly, or various directions outward.

Lower and upper fixed pulleys are each mounted on their respective mounting brackets using opposing vertically disposed plates, 42, 44 and 46, 48, all of which are welded to their respective mounting brackets, and all of which include apertures for inserting an axle. Lower axle 50 and upper axle 52 are thus inserted through a center bore in the lower and upper fixed pulleys, respectively, and then through an aperture in the vertical post 20. The upper and lower ends 54, 56 of the vertical post are also welded to the respective upper and lower mounting brackets. The brackets are fastened to the wall using screws 58 or other fasteners as required.

Vertical post 20 is shown as comprising square metal tubing. As will be appreciated, the cross-sectional geometry of the tubing is not limiting, as any of a number of shapes will work for all intended purposes. Adjustment of the movable pulley assembly 22 is achieved using a pulley carriage 60, slidably disposed around vertical post 20 with a section of tubing, the carriage center tube 62, having an interior opening only slightly larger than the outer dimensions of the vertical post. The clearances between the carriage center tube and the vertical post are tight but allow free vertical movement when the pulley carriage is not fixed in place on the vertical post by a ball lock pin 64 (i.e., a push button positive locking pin) disposed through the carriage center tube and the vertical post. (The pin is shown schematically with a T-handle, but it may have an L-handle, button handle, cup handle, or ring handle, according to user preferences.) Along those lines, it will be seen that the vertical post 20 includes a plurality of evenly spaced and aligned holes 66 passing through the vertical post (i.e., with holes on each of the opposing sides of the vertical post) and with which the hole (not shown) in the carriage center tube can be aligned for fixing the pulley carriage, and thus the movable pulley assembly, in a desired adjusted vertical position. In this manner, the user can select any of a number of exercise initiation points from which to begin an exercise (or "lift"). Alternatively, a clamping device attached to the movable carriage can be used in place of locking pin, eliminating the need for adjustment holes in vertical post and allowing unlimited adjustment within the top-to-bottom range.

The pulley carriage 60 includes right and left arms 68, 70, each having a grip 72, 74 for the user to hold while moving the pulley carriage up and down. FIGS. 2A through 3B illustrate the vertical range of movement available to the pulley carriage and pulley assembly. FIGS. 4A through 5B show only a few of countless exercises made possible by the vertical range available to the pulley assembly.

It will be appreciated that moving pulleys 30, 32 can be reduced to a single pulley without appreciably compromising the functional characteristics of the apparatus, particularly if the final fixed pulley from which it is routed is disposed sufficiently forward of the single movable pulley to ensure that the resistance tube engages the pulley regardless the position of the pulley carriage and the exercise initiation point.

Referring next to FIGS. 6 through 10 and 13, there is shown a second preferred embodiment 100 of the wall-mounted multi-position resistance tube apparatus of the present invention. All of the structural and operational elements of this embodiment are identical to those of the first preferred embodiment, with the following exceptions:

First, the lower and upper mounting brackets 102, 104, are adapted for rapidly removable installation on permanently installed lower and upper wall plates 106, 108. The lower mounting bracket 102 includes right and left aperture elements 110, 112 that cooperate with a slidable pin 114 and a fixed pin 116 that insert into the aperture elements to capture the lower bracket. The upper mounting bracket 104 is retained by fixed pins 118, 120 horizontally disposed on and slightly spaced apart from the upper wall plate 108. Mounting the apparatus entails placing the back vertical plate 122 of the upper bracket over the fixed pins 118 and 120 and sliding it between the pins and the wall plate. The lower bracket should then be brought into general alignment with the slidable and fixed pins of the lower wall plate so that the lower bracket can be secured.

Figure 13:
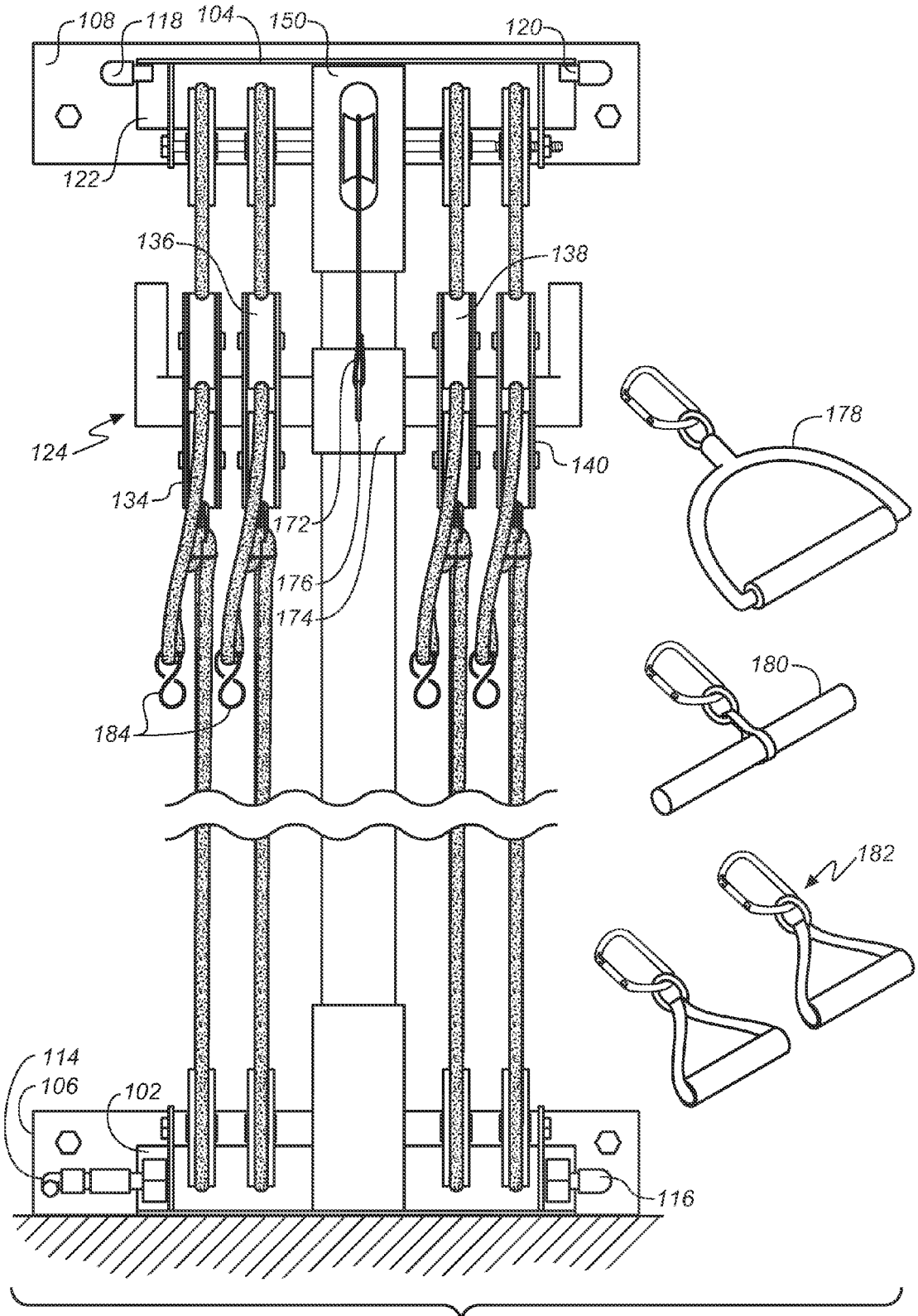
FIG. 13 is a front view in elevation of a fully rigged apparatus of the second preferred embodiment as it would be configured for a full range of heavy to light lifts.

Next, the pulley carriage 124 includes a plurality of mounting posts 126, 128, 130, 132, for mounting a plurality of double pulley assemblies 134, 136, 138, 140 [see FIG. 13]. Note that FIGS. 6-12 show only a single double pulley assembly mounted on the pulley carriage, but this is for clarity in the views only. However, it does properly suggest that the number of pulley assemblies to be mounted is entirely within the discretion of the user.

Figure 7:
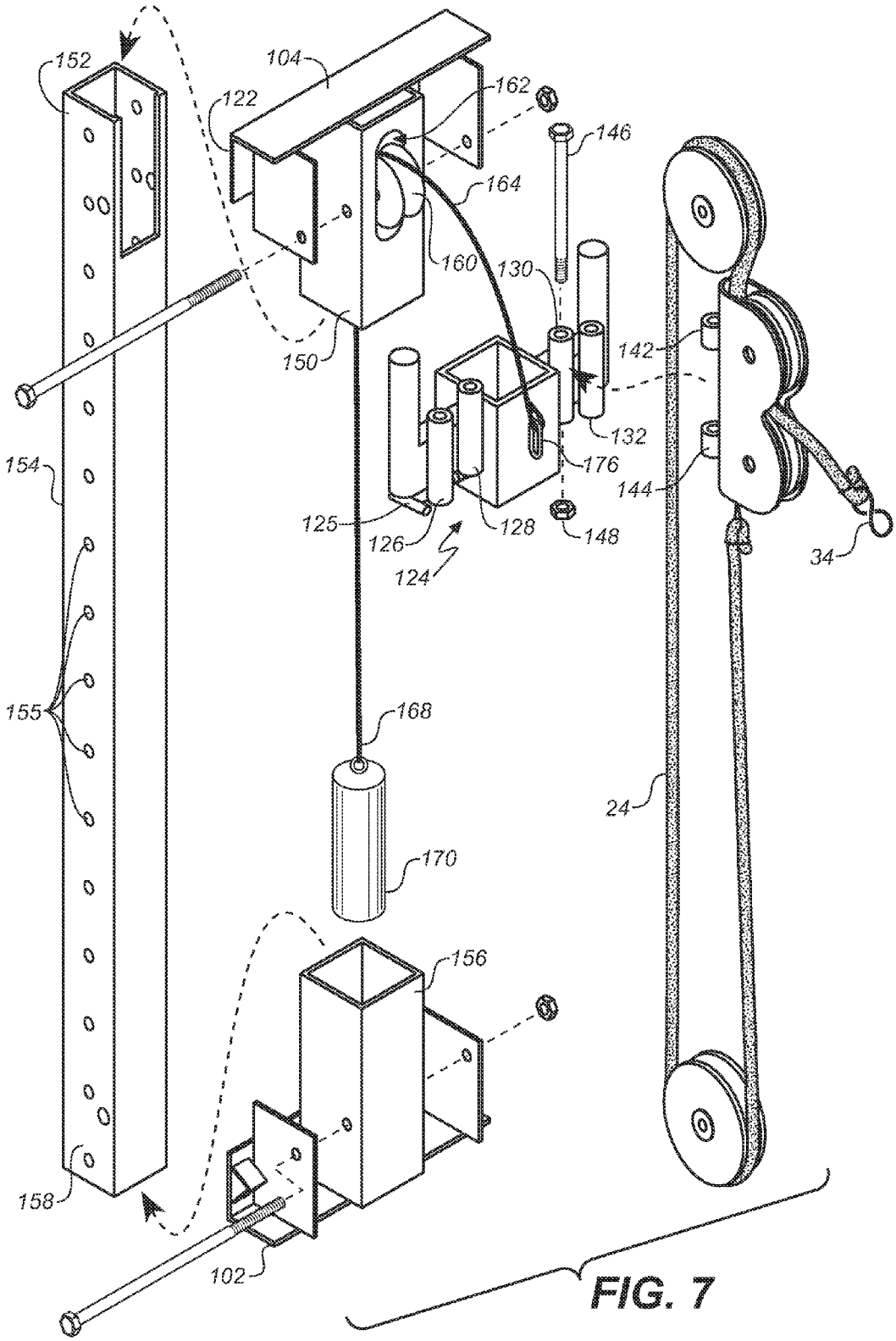
FIG. 7 is an exploded upper left front perspective view of the apparatus of FIG. 6.
Figure 8:
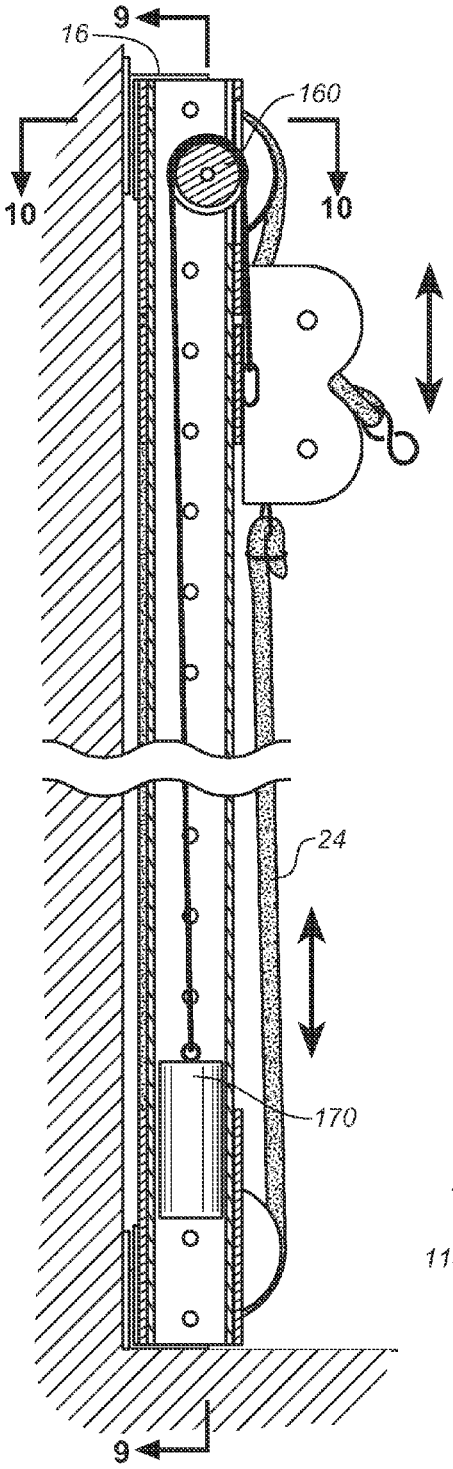
FIG. 8 is a schematic cross-sectional side view in elevation showing the movable pulley assembly in the uppermost position.
Figure 9:
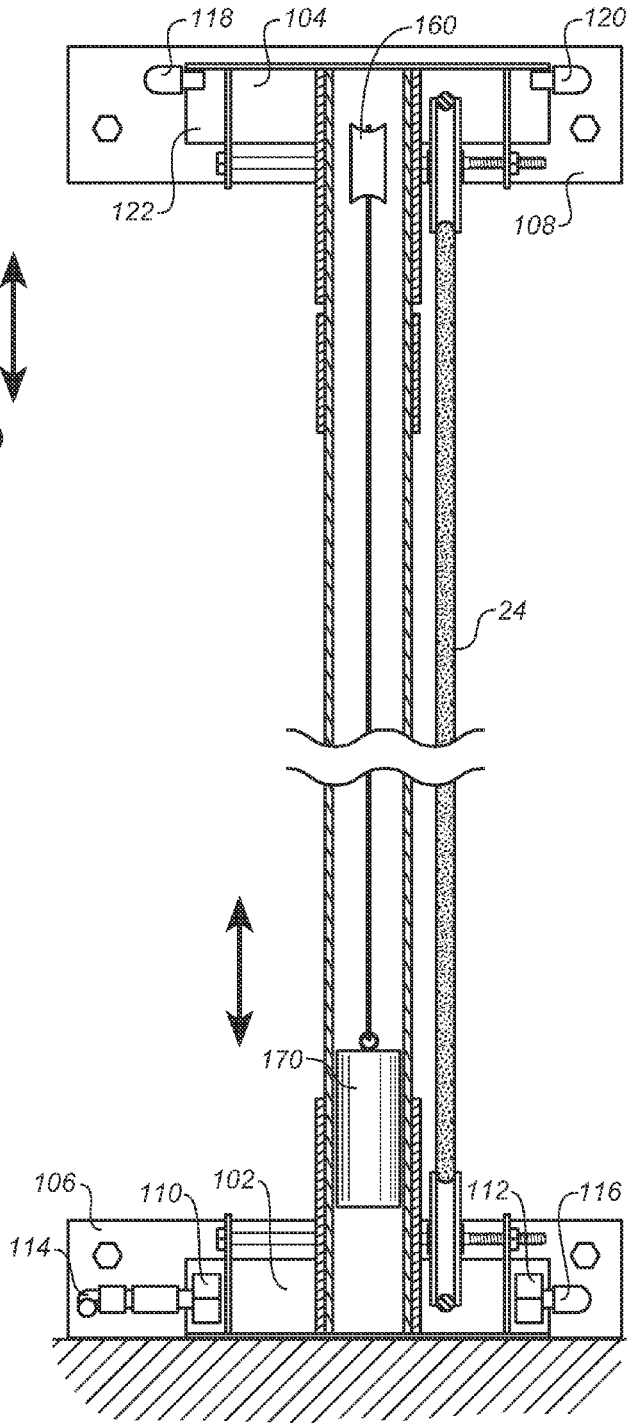
FIG. 9 is a schematic cross-sectional front view in elevation of the apparatus shown in FIG. 8.
Figure 10:
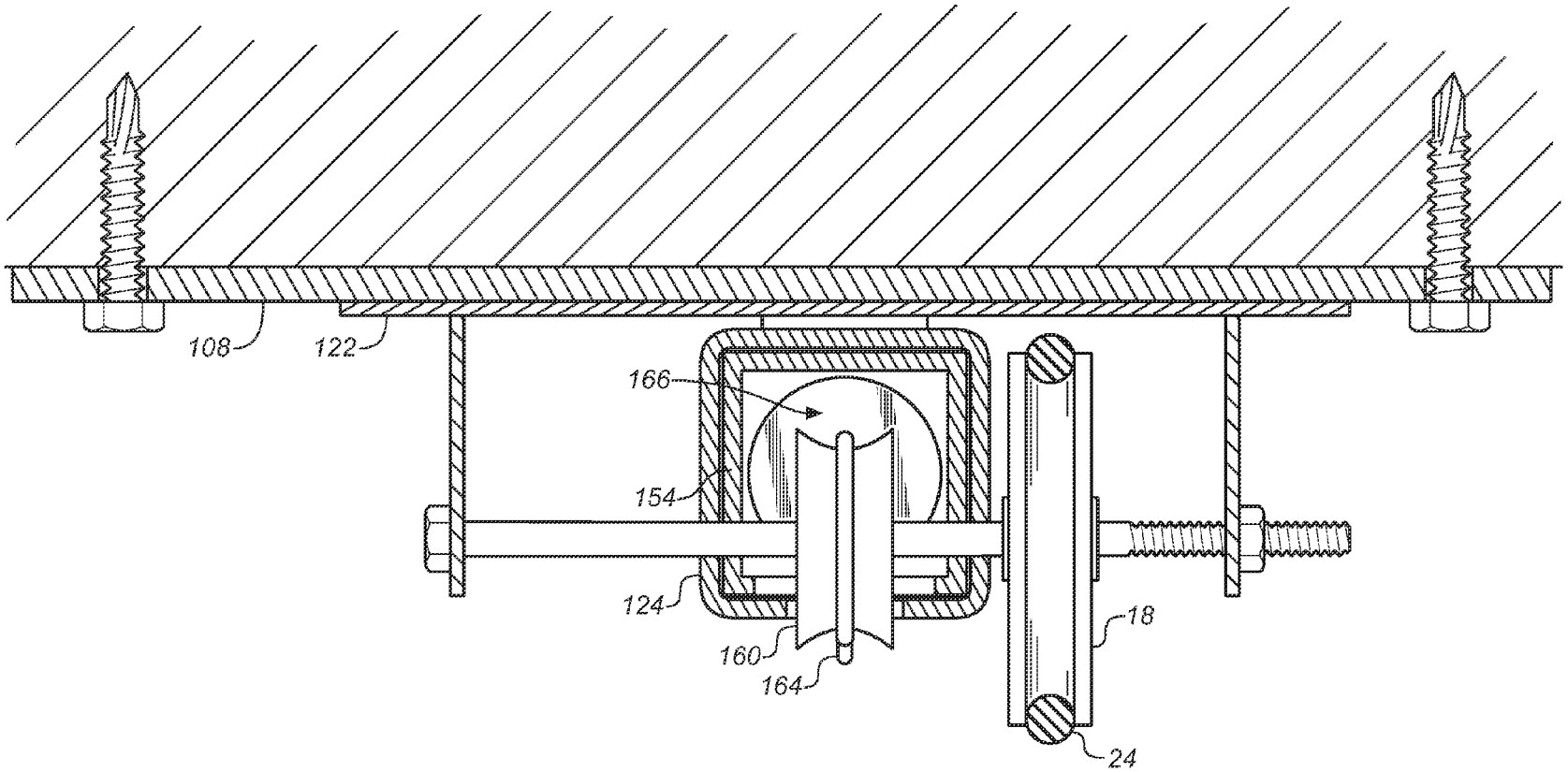
FIG. 10 is a cross-sectional plan view take along section lines 10-10 of FIG. 8.
Figure 11:
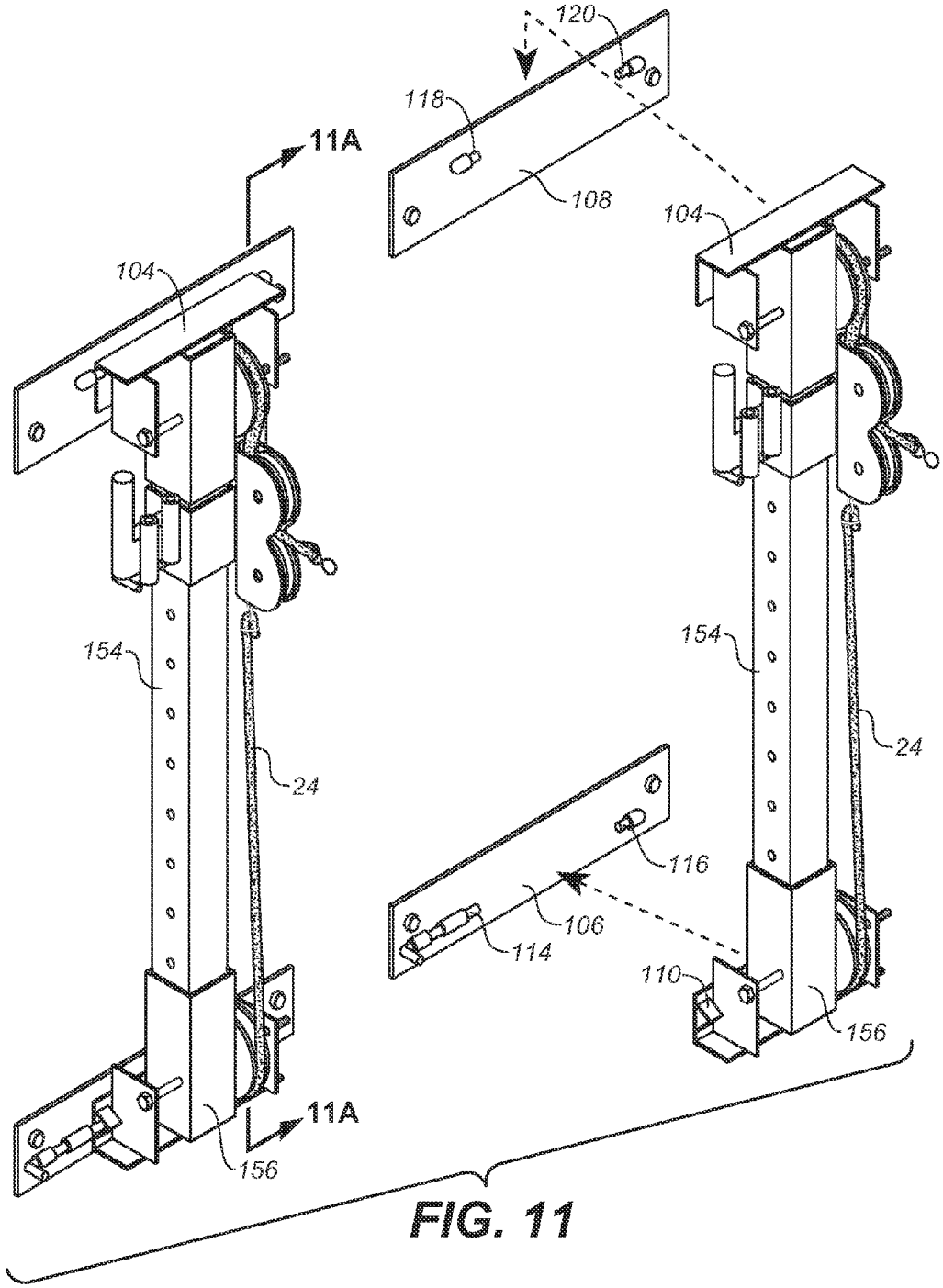
FIG. 11 is an upper left front perspective view showing a third preferred embodiment of the inventive apparatus detachably mounted on wall brackets.
Figure 11A:
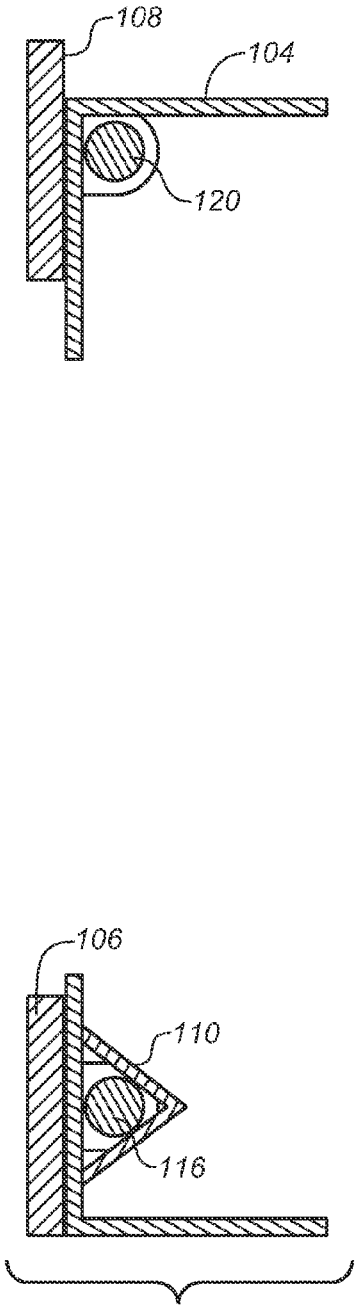
FIG. 11A is a cross-sectional side view in elevation of the mounting elements of the apparatus taken along section lines 11A-11A of FIG. 11.
Figure 12:
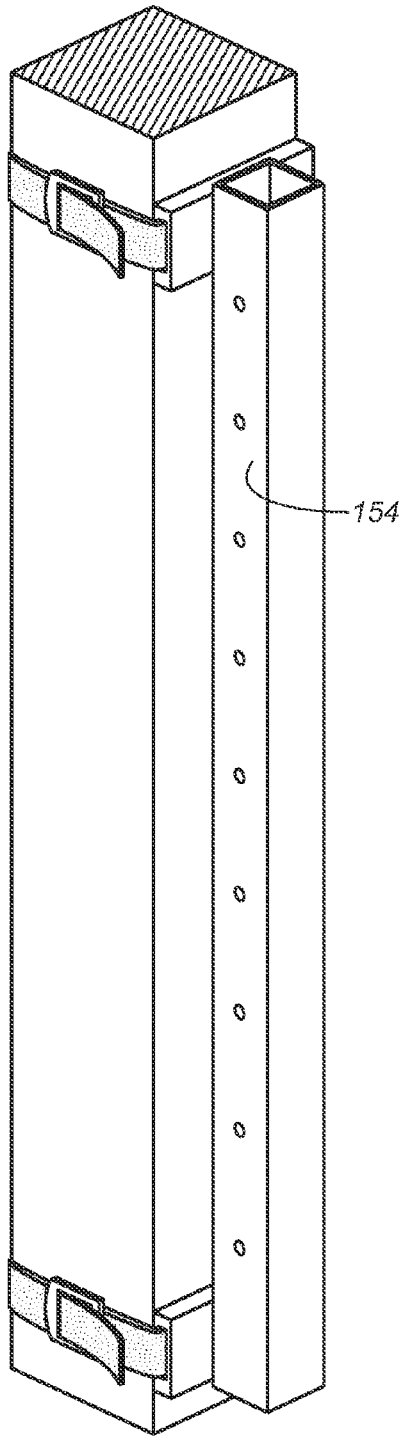
FIG. 12 is an upper left front perspective view showing an alternative way to mount the inventive apparatus using a post rather than a wall.

As can be seen in FIG. 7, each mounting post comprises a hollow cylinder (barrel, gudgeon, or eye), and the double pulley assemblies include upper and lower complementary rings, knuckles, or tubes 142, 144, that straddle a mounting post, wherein the holes through each are brought into alignment and the pulley assembly secured by a pin or bolt 146 fixed with a nut 148, much as in the manner of a door hinge. Indeed, some measure of swiveling may be desirable for each pulley assembly so as to allow a user slight variations in the angle at which he/she is positioned and pulling in relation to the pulleys.

Next, the second preferred embodiment includes a tube cap or vertical post receptacle 150 welded to the upper bracket 108 and encloses or is placed over the upper end 152 of vertical post 154. The lower bracket 102 includes a base socket or vertical post receptacle 156 welded to the lower bracket and into which the lower end 158 of the vertical post is disposed. A sheave 160 is axially disposed in a slot 162 in the vertical post and a cable 164 feeds over the sheave and down the interior 166 of the vertical post where it connects at its lower end 168 to a counterweight 170. At its upper end 172, the cable 164 is connected to the pulley carriage center tube 174 using any suitable means 176. The counterweight offsets the significant mass of the pulley carriage when equipped with multiple pulley assemblies.

The pulley carriage 124 is slidably adjustable vertically up and down the vertical post 154 using a pin or screw 125 inserted through the pulley carriage and selectively insertable into a plurality of holes 155 linearly disposed along the side of the vertical post.

As will be appreciated by reference to FIG. 13, the second preferred embodiment provides means for including a plurality of paired upper and lower fixed pulleys, a plurality of double pulley assemblies disposed on the movable pulley assembly, and a plurality of resistance tubes, one each disposed through one of the paired fixed upper and lower pulleys and double pulley assemblies, each of said resistance tubes connected at its first end to the movable pulley assembly. Thus, the force required to stretch the resistance tube is additive according to the number of tubes included in any given exercise. Further, various kinds of handles 178, 180, 182 can be employed according to their suitability for particular kinds of exercises. Additionally, each handle can be connected to one or more of the hooks 184 disposed on the ends of the resistance tubes so that resistance can easily be selectively increased or decreased appropriately.

Referring next to FIGS. 14 through 17, there is shown a third preferred embodiment 200 of the multi-position resistance tube exercise apparatus. As with the second preferred embodiment, the structural and operational elements of this embodiment are essentially identical to those of the first preferred embodiment. This embodiment includes lower and upper mounting brackets 202, 204, each adapted for installation on a wall.

First and second pulley boxes 206, 208 are affixed to the lower mounting bracket, in each of which are disposed a plurality of lower fixed pulleys 210. The upper mounting bracket 204 includes at least one pulley box 212 in which are disposed a plurality of upper fixed pulleys 214. The mounting brackets may be mounted in any of a number of ways, including insertion of fasteners through holes 216, 218 disposed in the lower and upper mounting brackets.

Figure 14:
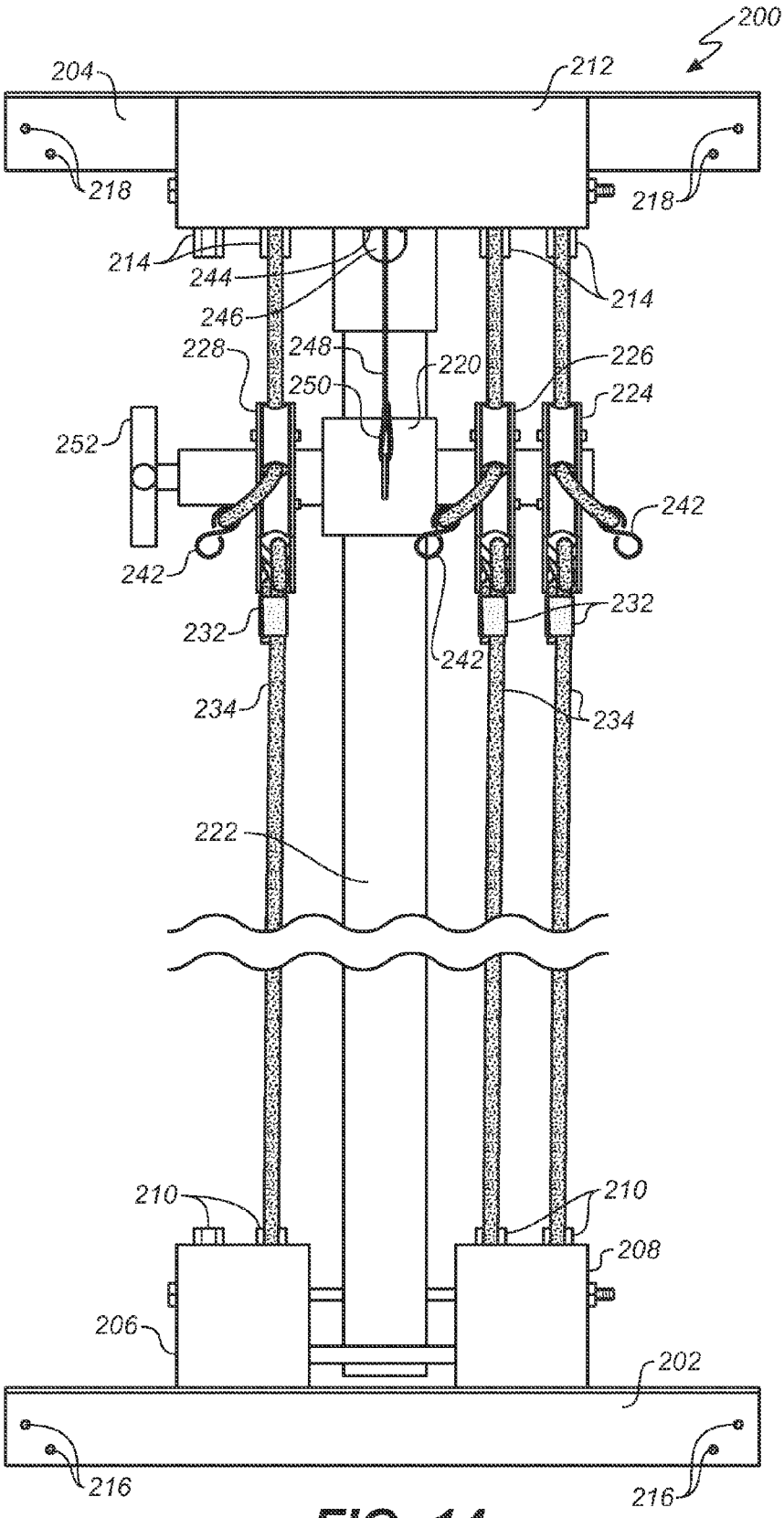
FIG. 14 is front view in elevation showing a third preferred embodiment of the inventive apparatus, which features an alternative means for affixing the first end of the resistance tube.
Figure 15:
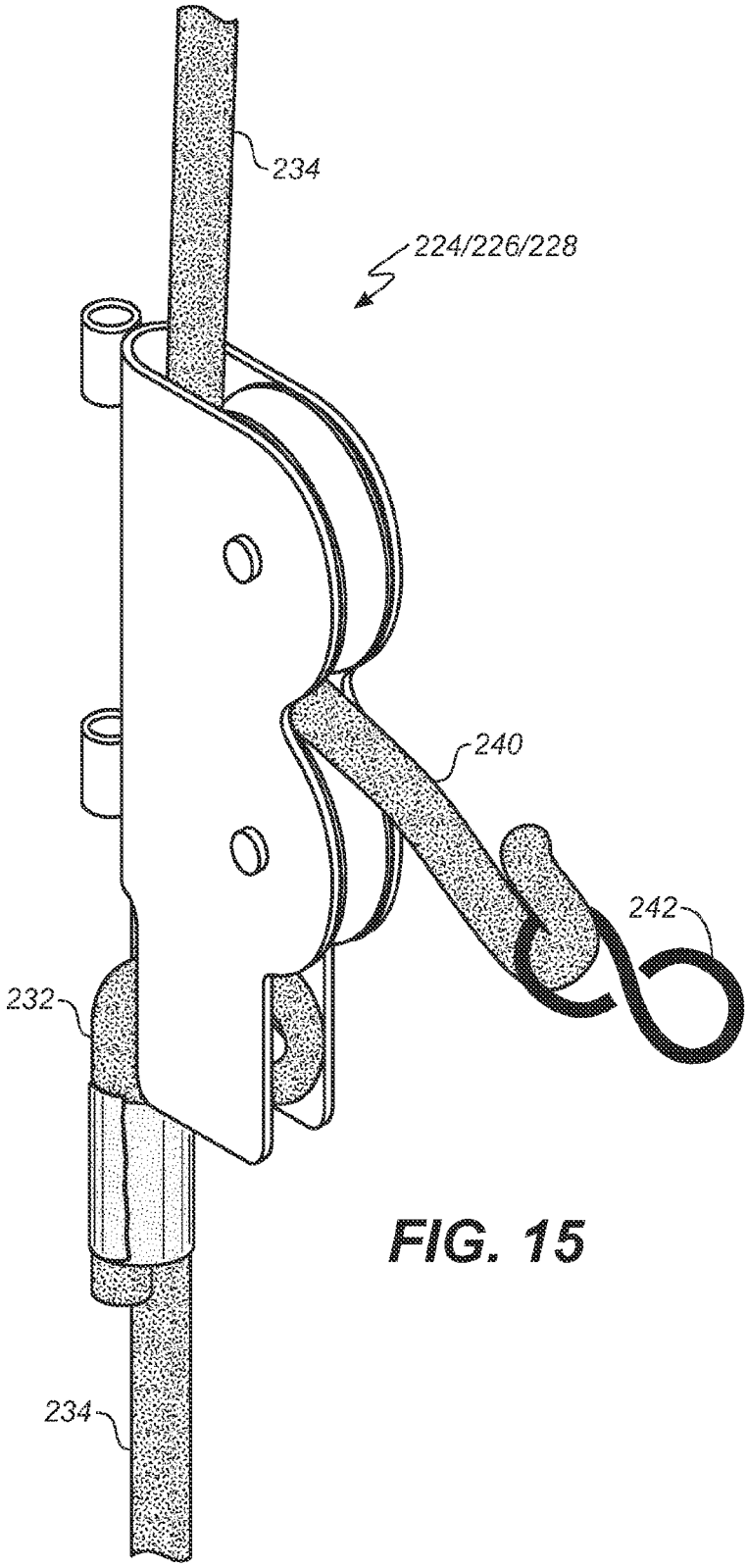
FIG. 15 is an upper front right perspective view showing an alternative means for affixing the first end of the resistance tube to the double pulley assembly.
Figure 16:
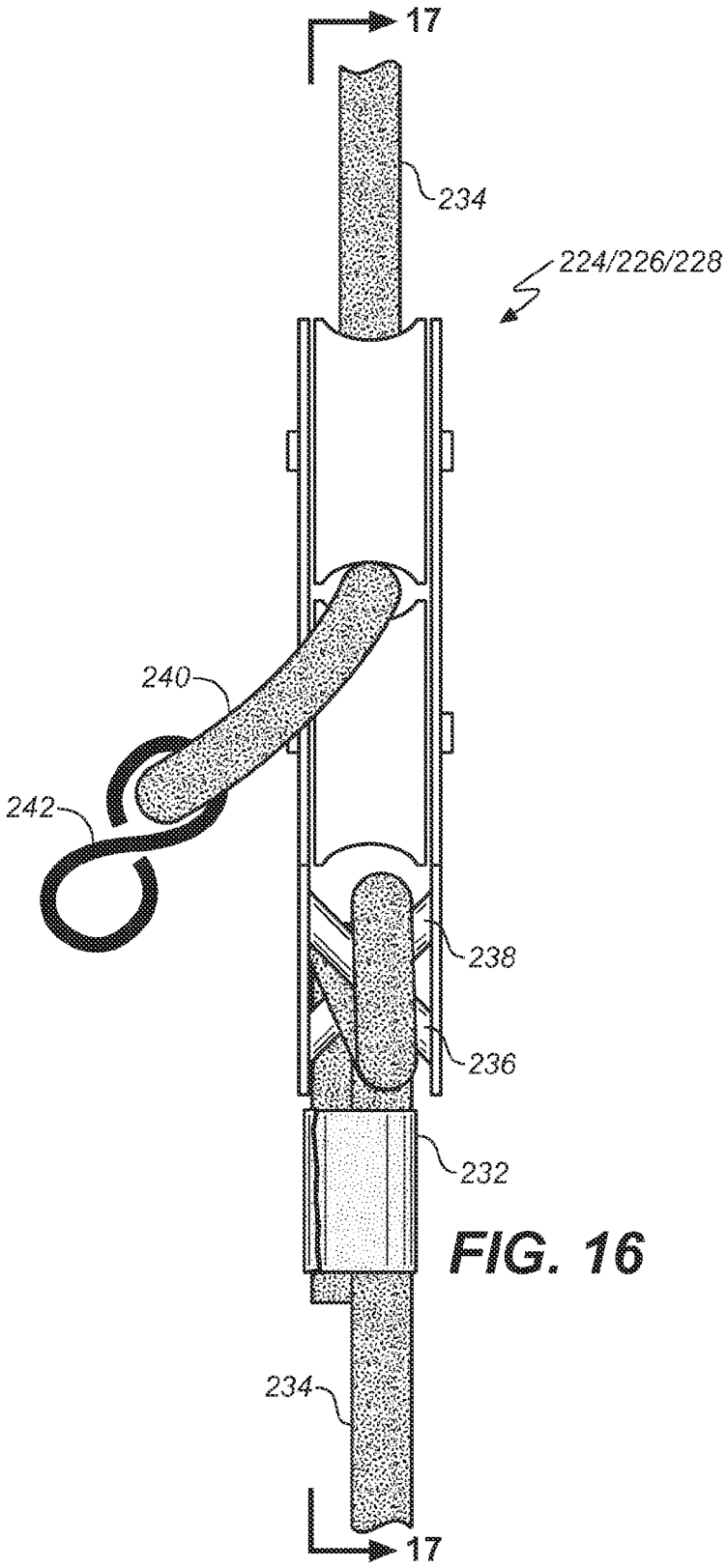
FIG. 16 is a front view in elevation thereof.
Figure 17:
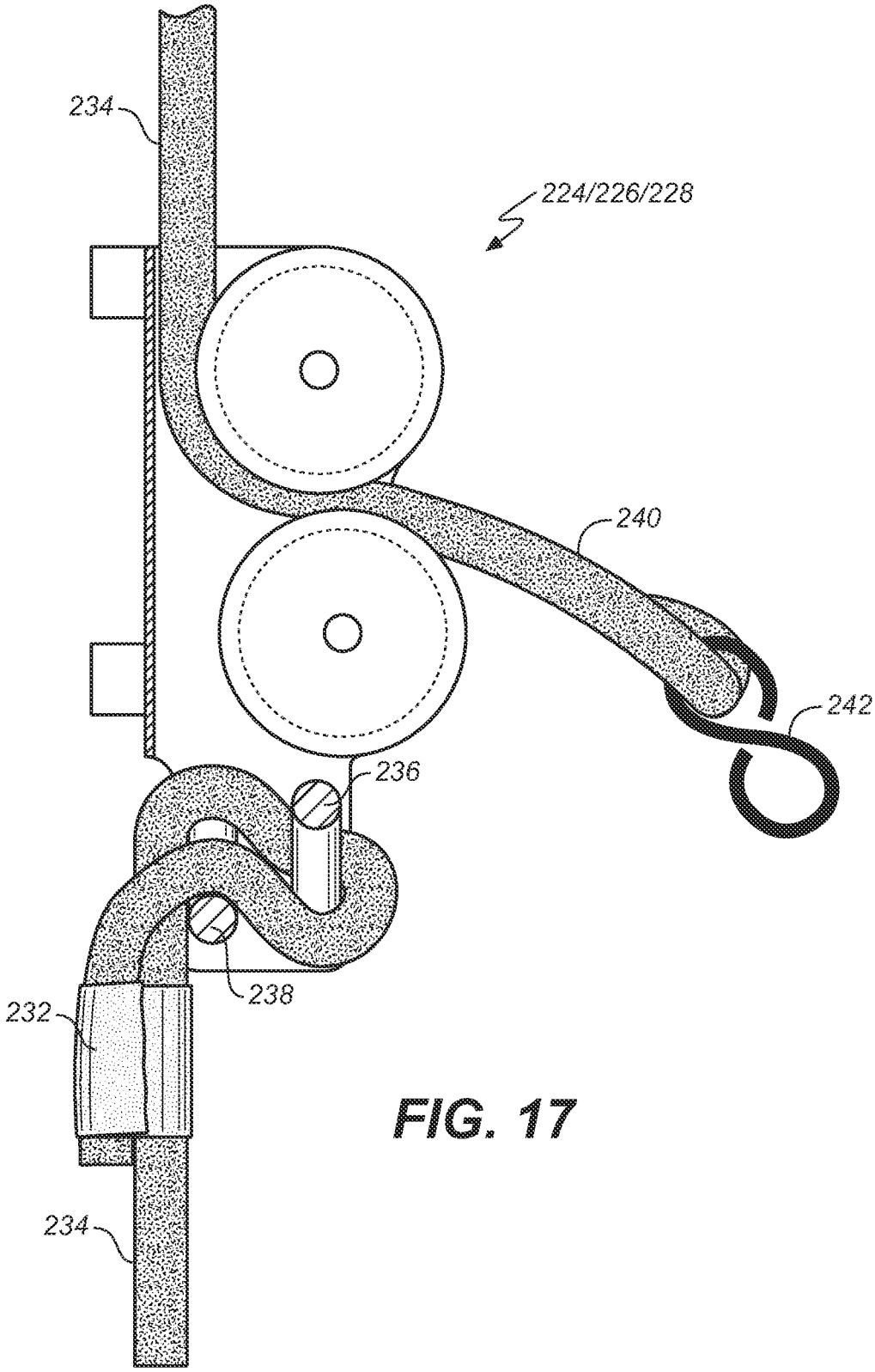
FIG. 17 is a cross-sectional side view in elevation thereof.
Figure 18:
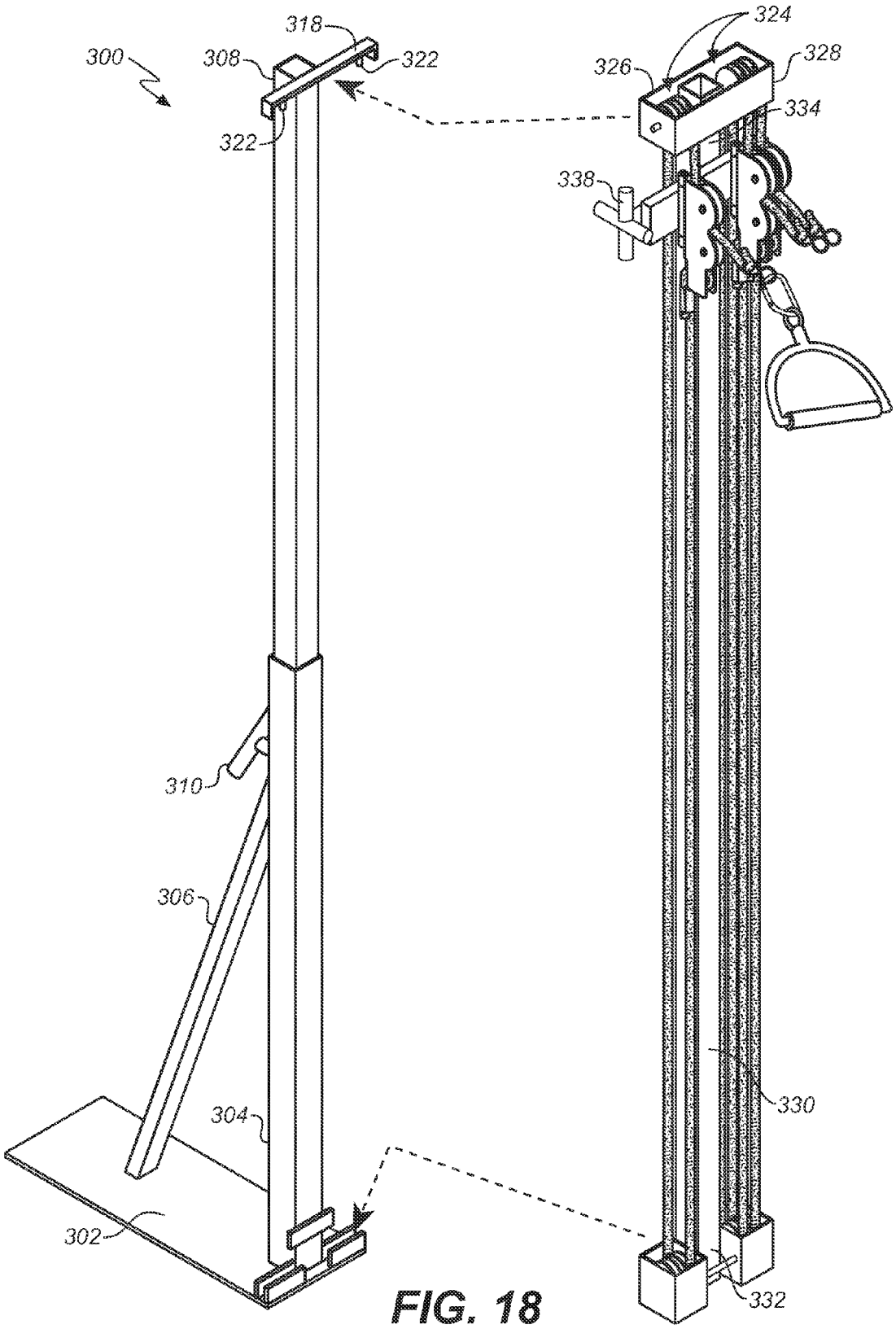
FIG. 18 is an exploded upper right front perspective view of a fourth preferred embodiment of the inventive apparatus, configured for installation under a heavy mass.

A pulley carriage 220 is slidably adjustable up and down vertical post 222 and includes a plurality of mounting posts (not shown in these views) for mounting a plurality of double pulley assemblies 224, 226, 228, 230. The vertical post is connected at its upper and lower ends to the upper and lower mounting brackets, either directly or through intervening structure. The mounting posts and double pulley assemblies are in most respects identical to those shown in FIGS. 1-13. However, and referring now to FIGS. 15-17, in this alternative embodiment, the first end 232 of resistance tube 234 is threadably inserted through a configuration of front and back crossed diagonal posts 236, 238. The threading pattern is for the first end of the resistance tube to pass over the back diagonal post 238, then over and around the first diagonal post 236, then over the back diagonal post, and out the bottom of the double pulley assembly. The second end 240 of the resistance tube is threaded around a lower fixed pulley, then an upper fixed pulley, and then through the double pulley assembly, as described above. Again, the second end includes a connector or hook 242 to which a handle, grip, or other apparatus may be coupled. Note: FIG. 14 shows three double pulley assemblies mounted on the pulley carriage, through at least a fourth is implied in the view. Again, the view shows that the number of pulley assemblies to be mounted is within the discretion of the user.

The third preferred embodiment also a sheave 244 axially disposed in a slot 246 in the vertical post 222, and a cable 248 feeds over the sheave and down the interior of the vertical post where it connects at its lower end to a counterweight. At its upper end 250, the cable is connected to the pulley carriage center tube. The pulley carriage 220 is slidably adjustable vertically up and down the vertical post 222 using a screw 252 which either inserts into a plurality of holes linearly disposed along the side of the vertical post or directly engages the side of the vertical post and exerts pressure sufficient to maintain the position of the pulley carriage under the loads expected to be borne by the apparatus when in use.

FIGS. 18-23 show a fourth preferred embodiment 300 of the present invention. This embodiment is intended for use when a wall is not available as a support structure for the pulley assembly and the vertical post. Accordingly, a transportable mounting structure is provided, which includes a base or platform 302 is provided on which base post 304 is disposed. The base post is braced with a diagonal brace 306, and a telescopically extensible upper base post 308 is adjustable inserted into the base post and secured using a screw 310. The base post includes a lower bracket 312 onto which a lower fixed pulley assembly 314 is mounted using an integral or affixed channel other mounting structure 316 that cooperates with the lower bracket 312. The extensible upper base post 308 includes a cap 318 mounted on its upper end 320 and having downwardly oriented pins 322 that insert into holes 324 in the top 326 of upper fixed pulley assembly 328.

Vertical post (mast) 330 is disposed between and connected to the lower and upper fixed pulley assemblies at its lower and upper ends 332, 334, respectively. The vertical post 330 is removable from base 302. The operative and movable elements of this embodiment are otherwise identical to those of the third preferred embodiment, including the vertically adjustable pulley carriage 336 and the mechanism 338 for adjusting the same, as well as the means of attaching the first end of the resistance tube.

Figure 19:
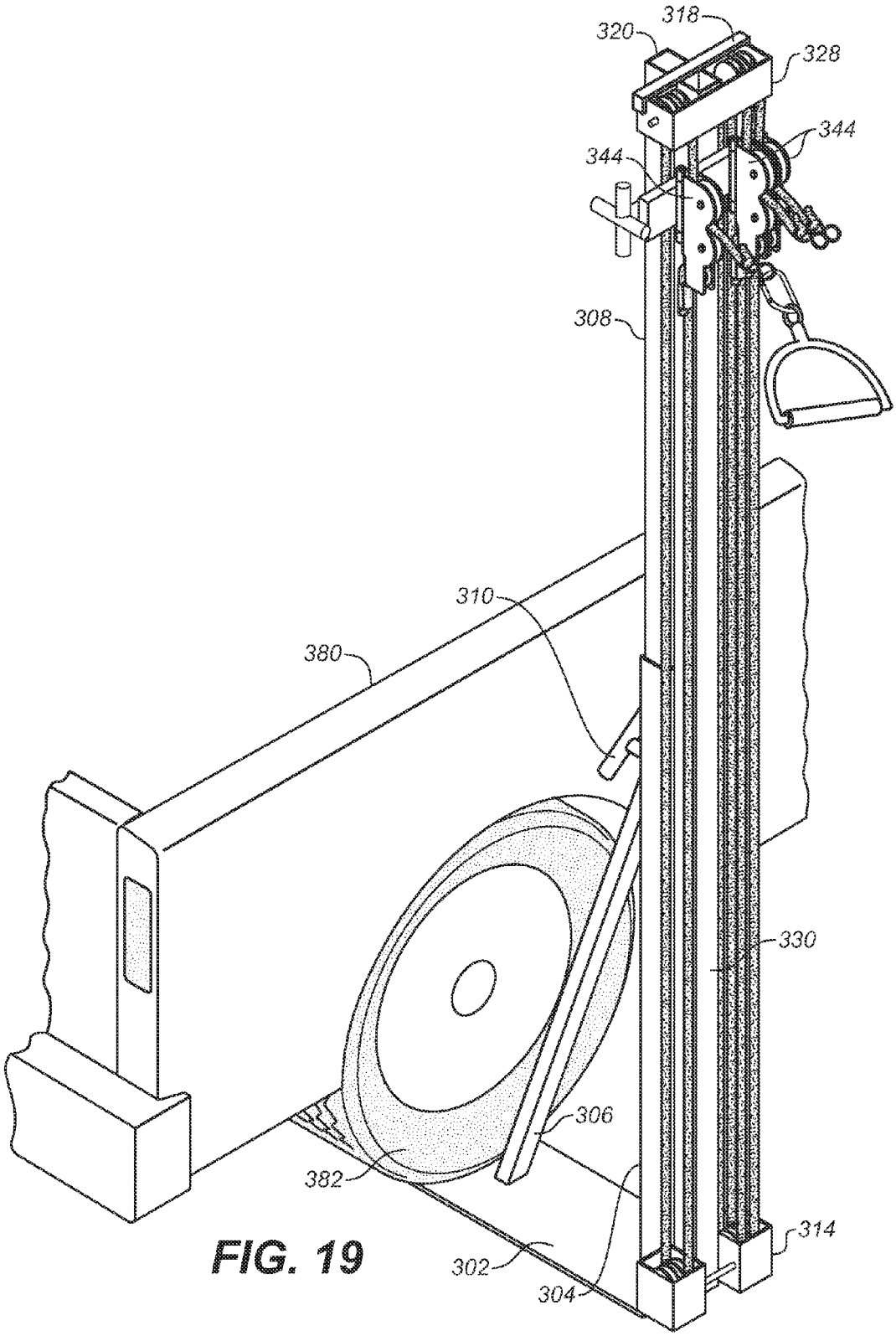
FIG. 19 is an upper right front perspective view showing the fourth preferred embodiment pinned and secured to the ground using the mass of a motor vehicle.
Figure 20:
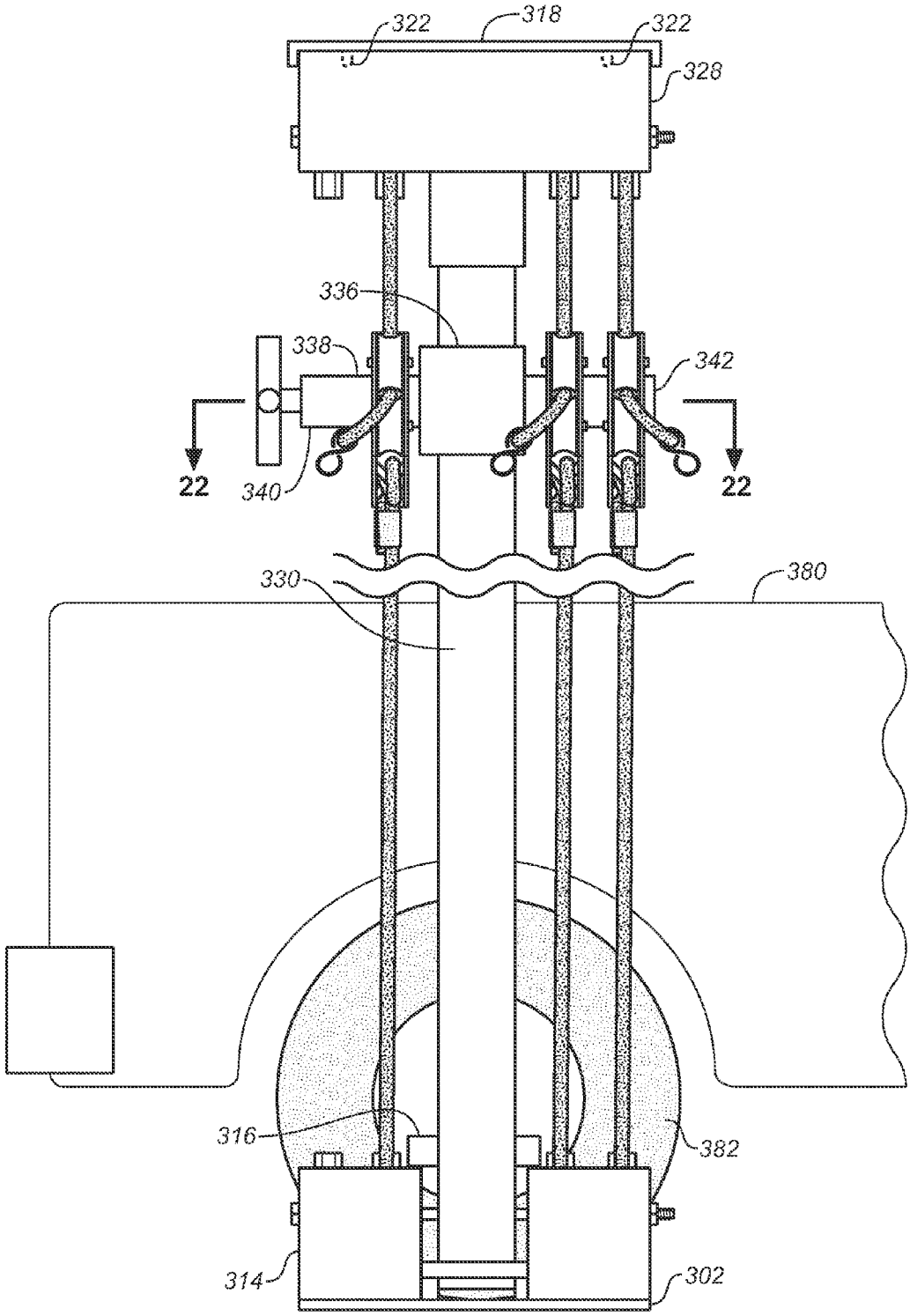
FIG. 20 is a front view in elevation thereof.
Figure 21:
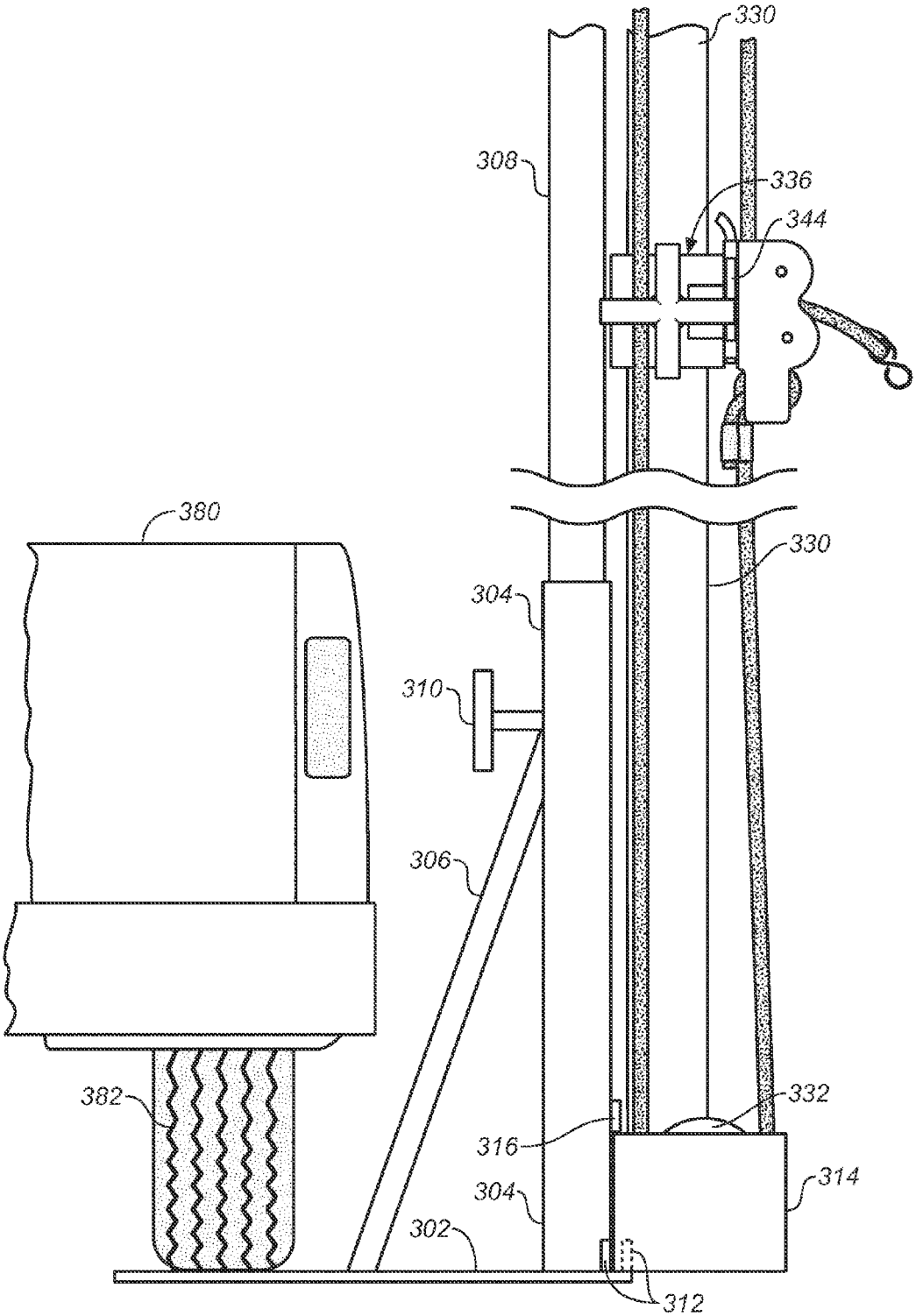
FIG. 21 is a side view in elevation thereof.
Figure 22:
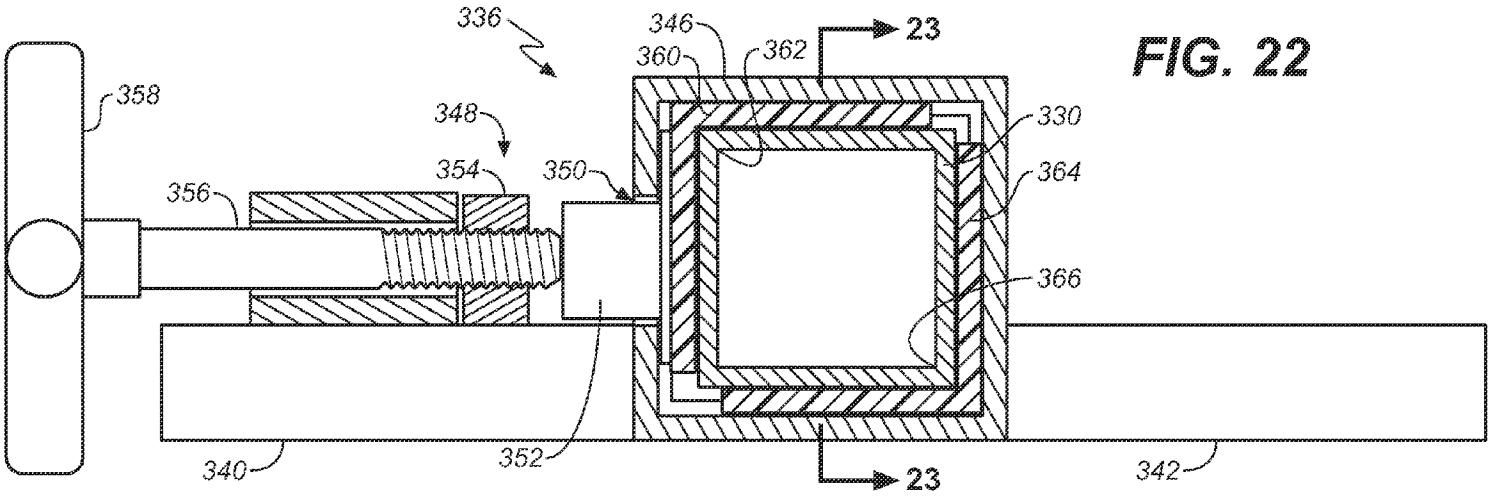
FIG. 22 is a cross-section top plan view of the pulley carriage adjustment apparatus as employed in the fourth preferred embodiment as take along section line 22-22 of FIGS. 20.
Figure 23:
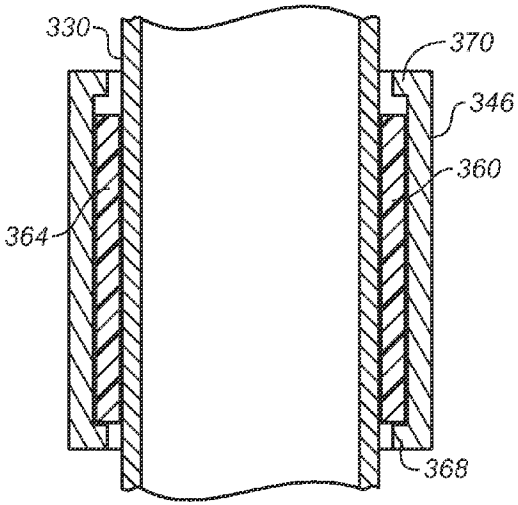
FIG. 23 is a cross-sectional side view in elevation thereof as taken along section line 23-23 of FIG. 22.

Details of the pulley carriage 336 can be seen by reference to FIGS. 19 and 22-23. Here is it seen that the pulley carriage 336 includes right and left horizontally disposed bars 340, 342 on which the mounting posts for the double pulley assemblies 344 are swivelingly mounted. The horizontally disposed bars are welded to or integral with a slidably adjustable center box 346 which clamps onto vertical post 330 using a clamping mechanism 348 as shown. The slidably adjustable center box 346 includes a hole 350 in one side into which a reciprocating plunger 352 is slidably inserted. A threaded boss 354 is welded to or otherwise affixed to the back side of one of the horizontally disposed bars and a threaded pin 356 having a turnable adjustment knob 358 is inserted through the boss until it engages the plunger. When tightened, the plunged engages a first loosely disposed plastic or nylon angle stock piece 360 which is approximated to a first corner 362 of vertical post 330 with very slight clearances to allow free vertical movement of the center box on the vertical post. When the pin 356 is sufficiently tightened, the first angle stock piece and the vertical post are tightly urged against a second loosely disposed angle stock piece 364 approximated to a second corner 366 diagonally opposite the first corner 362, and this prevents further movement of the center box 346 on the vertical post. The loosely disposed angle stock pieces are retained within the center box by lower and upper shelves 368, 370, integral with the inner sides of the center box. UHMW (ultra-high-molecular-weight polyethylene), nylon, or other comparable materials are suitable for use in making the angle stock.

In this manner, there is provided a way for truckers and other individuals who travel extensively by truck or car to set up a support structure for mounting the pulley assemblies and the vertical post. To accomplish the mounting, the base 302 is placed on the ground and a motor vehicle 380 is driven onto the base so that a vehicle tire 382 bearing a substantial portion of the weight of the vehicle pins the base to the ground. The upper base post is telescopically extended sufficiently to a length that will accommodate the vertical posts and the fixed pulley assemblies mounted thereon. The upper base post is then shortened until the pins.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

The invention claimed is:

1. Exercise apparatus, comprising:

upper and lower mounting brackets;

an upper fixed pulley mounted in said upper mounting bracket;

a lower fixed pulley mounted on said lower mounting bracket;

a vertical post connected to and disposed between said upper and lower mounting brackets;

a movable pulley assembly having at least one movable pulley disposed on a pulley carriage, said pulley assembly slidably and adjustably mounted on said vertical post;

adjustment apparatus for selectively locking and unlocking said movable pulley assembly in various positions on said vertical post;

a resistance tube connected at a first end to said movable pulley assembly and operably threaded around a portion of said lower fixed pulley, and a portion of said upper fixed pulley, and said at least one movable pulley so as to engage said movable pulley during lifts and such that a second end of said resistance tube extends outwardly from said movable pulley assembly, said second end having attachment apparatus for connecting said resistance tube to a handle.

2. The exercise apparatus of claim 1, wherein said resistance tube does not stretch, such that the length of said resistance tube does not change, as the position of said movable pulley assembly is adjusted on said vertical post.

3. The exercise apparatus of claim 2, wherein the stretch of said resistance tube is continuous from said second end to said first end when said second end is translated away from said movable pulley assembly.

4. The exercise apparatus of claim 2, including a plurality of paired upper and lower fixed pulleys, a plurality of movable pulleys disposed on said movable pulley assembly, and a plurality of resistance tubes, one each disposed through one of said paired fixed upper and lower pulleys and at least one of said movable pulleys, each of said resistance tubes connected at its first end to said movable pulley assembly.

5. The exercise apparatus of claim 4, further including a counterweight connected to said pulley carriage.

6. The exercise apparatus of claim 4, wherein said fixed upper pulleys are mounted in a side-by-side relationship on a common upper axle, and said fixed lower pulleys are mounted in a side-by-side relationship on a common lower axle.

7. The exercise apparatus of claim 1, wherein said movable pulley assembly includes first and second movable pulleys disposed in a stacked configuration, and wherein said resistance tube is routed either first over said upper fixed pulley and then under said lower fixed pulley, or first under said lower fixed pulley and then over said upper fixed pulley, and thereafter through said movable pulley assembly such that a second end of said resistance tube extends from between said first and second movable pulleys.

8. A multi-position exercise apparatus, comprising:

mounting apparatus for mounting said exercise apparatus either permanently or selectively removably from a vertically oriented structure;

at least one lower fixed pulley;

at least one upper fixed pulley;

a vertical post disposed between said at least one upper pulley and said at least one lower fixed pulley;

a movable pulley assembly having at least one pulley wheel, said movable pulley assembly slidably and adjustably mounted on said vertical post;

a locking mechanism for selectively locking and unlocking said movable pulley assembly at an adjusted position;

at least one resistance tube affixed at a first end to either a top or a bottom end of said movable pulley assembly and operably threaded around a portion of said at least one lower fixed pulley, and a portion of said at least one upper fixed pulley, and behind said at least one pulley wheel of said movable pulley assembly; and a handle attachment affixed to a second end of said resistance tube for attaching one of a variety of handle types.

9. The multi-position exercise apparatus of claim 8 wherein said mounting apparatus includes an upper mounting bracket and a lower mounting bracket, said at least one lower fixed pulley is mounted on said lower mounting bracket, and said at least one upper fixed pulley is mounted on said upper mounting bracket.

10. The multi-position exercise apparatus of claim 9, wherein said upper and lower mounting brackets each include opposing vertically disposed plates, and wherein each of said lower and upper fixed pulleys are mounted on their respective mounting brackets using an axle disposed through said opposing vertically disposed plates.

11. The multi-position exercise apparatus of claim 8, wherein said movable pulley assembly includes a pulley carriage having a carriage center tube slidably disposed around said vertical post, said carriage center tube having an interior opening shaped to conform to the cross-sectional shape of said vertical post and sized slightly larger than the outer dimensions of said vertical post, such that clearances between said carriage center tube and said vertical post are small enough to prevent free movement during use and in a locked position, but large enough to permit said pulley carriage to slide up or down said vertical post when said pulley carriage is not fixed in place on the vertical post in a locked position.

12. The multi-position exercise apparatus of claim 11, wherein said locking mechanism is a screw clamp.

13. The multi-position exercise apparatus of claim 11, wherein said vertical post includes a plurality of through holes, said carriage center tube includes a through hole that can be brought into alignment with the through holes in said vertical post, and said locking mechanism is a pin that may be selectively inserted into or removed from the aligned through holes.

14. The multi-position exercise apparatus of claim 8, wherein said pulley assembly includes grips for use in manually moving said pulley assembly up and down said vertical post.

15. The multi-position exercise apparatus of claim 8, wherein said vertical post includes an upper end and a lower end, and wherein said upper end is mounted on an upper mounting bracket and said lower end is mounted on a lower mounting bracket.

16. The multi-position exercise apparatus of claim 15, further including lower and upper wall plates, wherein said upper and lower mounting brackets cooperate with said upper and lower wall plates to provide means for rapid installation and removal from a wall or other vertically oriented surface.

17. The multi-position exercise apparatus of claim 8, further including an upper vertical post receptacle affixed to an upper mounting bracket and a lower vertical post receptacle affixed to a lower mounting bracket, and wherein said vertical post includes an upper end and a lower end, said upper end removably disposed in said upper vertical post receptacle and said lower end removably disposed in said lower vertical post receptacle.

18. The multi-position exercise apparatus of claim 17, wherein said lower mounting bracket and said mounting upper bracket each include aperture elements that cooperate with pins to capture and retain said lower mounting bracket and said upper mounting bracket on upper and lower wall plates.

19. The multi-position exercise apparatus of claim 18, wherein said pins include a slidable pin and a fixed pin disposed on said lower wall plate, and fixed pins horizontally disposed on and slightly spaced apart from said upper wall plate, wherein mounting said upper and lower mounting brackets on said wall plates involves placing a back vertical plate of said upper bracket over said fixed pins and sliding said vertical plate between said fixed pins and said upper wall plate, and placing said lower mounting bracket into general alignment with said slidable and said fixed pin disposed on said lower wall plate such that said lower mounting bracket can be secured.

20. The multi-position exercise apparatus of claim 8, wherein said movable pulley assembly includes a plurality of mounting posts for mounting a plurality of movable pulley wheels.

21. The multi-position exercise apparatus of claim 20, wherein each of said mounting posts comprises a hollow cylinder, and said movable pulley assembly includes upper and lower complementary knuckles that straddle a mounting post, wherein holes through each of said mounting posts and said knuckles are brought into alignment and said pulley assembly is secured by locking apparatus.

22. The multi-position exercise apparatus of claim 8, further including a sheave axially disposed in a slot in said vertical post and a cable that feeds over said sheave and down the interior of said vertical post where it is connected at a lower end to a counterweight and at its upper end to a pulley carriage center tube.

23. The multi-position exercise apparatus of claim 8, wherein said movable pulley assembly includes pulley carriages having diagonally opposing fingers disposed either under or over said pulley wheels, such that a second end of said resistance tube can be selectively threaded through said opposing, and said diagonally opposing fingers to create a connection that tightens when said resistance tube is pulled away from said pulley carriage and easily loosened for removal when relaxed.

* * * * *